US005996629A

United States Patent [19]

Sato et al.

[11] Patent Number: 5,996,629

[45] Date of Patent: Dec. 7, 1999

[54] PILOT SOLENOID VALVE

[75] Inventors: Hideharu Sato; Shinji Miyazoe; Takumi Matsumoto; Makoto Ishikawa, all of Yawara-mura, Japan

[73] Assignee: SMC Corporation, Tokyo, Japan

[21] Appl. No.: 09/156,692

[22] Filed: Sep. 18, 1998

Related U.S. Application Data

[63] Continuation-in-part of application No. 08/816,896, Mar. 13, 1997, abandoned, and a continuation-in-part of application No. 08/820,093, Mar. 19, 1997, abandoned.

[30] Foreign Application Priority Data

Apr. 3, 1996 [JP] Japan ..... 8-106308
Apr. 3, 1996 [JP] Japan ..... 8-106309

[51] Int. Cl.[6] ..... F15B 13/043

[52] U.S. Cl. ..... 137/625.64; 137/382; 137/884

[58] Field of Search ..... 137/382, 625.64, 137/884

[56] References Cited

U.S. PATENT DOCUMENTS 4,726,393 2/1988 Herner ..... 137/625.64 X
5,437,306 8/1995 Asou et al. ..... 137/625.64
5,588,465 12/1996 Witkowski et al. ..... 137/625.64
5,615,710 4/1997 Sato ..... 137/625.64
5,664,604 9/1997 Sato et al. ..... 137/884

*Primary Examiner*—Gerald A. Michalsky
*Attorney, Agent, or Firm*—Oblon, Spivak, McClelland, Maier & Neustadt, P.C.

[57] ABSTRACT

A valve installation surface of a manifold base includes an installation surface on which a main valve and two pilot valves and are installed, separate from each other. The manifold base includes a supply channel, ejection channels and an output port that opens to a front end surface, all opening to the main valve installation surface. One end of pilot supply passages and communicates with pilot supply and ejection channels and, respectively. The other ends of pilot ejection passages and are open to the pilot valve installation surface. One end of pilot output passages and opens to the pilot valve installation surface, while the other ends are open to the main valve installation surface. A manifold base may also include a waterproof cover that covers the pilot valves and the energization system, extending from the feeding line to the pilot valve. The main valve may be a single or double solenoid.

8 Claims, 20 Drawing Sheets

PILOT SOLENOID VALVE

This application is a continuation-in-part of application Ser. No. 08/816,896 filed Mar. 13, 1997, now abandoned, and application Ser. No. 08/820,093 filed Mar. 19, 1997, now abandoned.

BACKGROUND OF THE INVENTION

1. Field of the Invention

The present invention relates to a pilot solenoid valve that is installed on a manifold base to drive the valve body of a main valve using pilot fluid supplied or ejected through pilot valves driven by a solenoid, and that switches the output opening of the main valve between a supply opening and an ejection opening for communication.

2. Description of the Related Art

Pilot solenoid valves that include a main valve installed on a manifold base and pilot valves attached to the main valve to drive the valve body of the main valve using a pilot fluid which is supplied or ejected through the pilot valves, and that switches the output opening of the main valve between a supply opening and an ejection opening for communication are well known and need not be illustrated here.

If such well-known pilot solenoid valves are used in a very humid working environment, for pilot valves that have an electrical section, the energization system must be protected to prevent accidents that could be caused by water. It is difficult and expensive, however, to make only the pilot valves attached to the main valve and the energization system water proof or moisture-proof. Therefore, so it is simpler and more effective to cover all the valves including a large number of the main valves arranged on manifold bases to protect them from water.

When, however, the pilot solenoid valve is waterproof, the cover must be removed to disable the overall waterproof function each time maintenance or inspection of the main or pilot valves is carried out or a defective part is replaced even if said maintenance or inspection involves parts other than the pilot valves, which do not require a waterproof function. This might cause some troubles and is also a problem that makes maintenance and inspection cumbersome. In addition, the pilot solenoid valve normally includes a manual operation section that allows the main or pilot valves to be manually opened and closed when power supply is interrupted or the valves becomes defective. In such a case, the cover must also be removed to disable the overall waterproof function.

SUMMARY OF THE INVENTION

It is an object of this invention to provide a pilot solenoid valve that has a simple structure protecting only the pilot valves and the energization system from water.

It is another object of this invention to provide a pilot solenoid valve that enables the maintenance, inspection, and replacement of parts other than the pilot valves and the energization system without disabling the waterproof function, and that allows the above work to be carried out independently of the above waterproofed section.

It is yet another object of this invention to provide a pilot solenoid valve that allows a common cover to be used for a pilot solenoid valve with one or two pilot valves.

It is still another object of this invention to provide a pilot solenoid valve that allows the manual operation section provided therein to be operated easily without disabling the waterproof function of the pilot valves.

To achieve this aim, a first aspect of the invention provides a pilot solenoid valve comprising a manifold base, a main valve for switching the output opening between a supply opening and an ejection opening for communication, and pilot valves driven by a solenoid to drive the valve body of the main valve, the pilot solenoid valve axially driving the valve body of the main valve using a pilot fluid which is supplied or ejected through the pilot valves in order to switch the channel between the openings for communication, characterized in that the main and pilot valves are independently installed on the manifold base so as to be separated from each other and arranged parallel to the axial direction of the valve body of the main valve, and in that the manifold base includes a feeding line housing passage through which pass feeding lines for feeding the pilot valves; and a waterproof cover covering the pilot valves and the energization system extending from the feeding line to the pilot valve.

In this pilot solenoid valve, an installation surface for the two solenoid-driven pilot valves that drive the valve body of the main body in its axial direction either forward or backward is provided on the manifold base in the axial direction of the valve body of the main body or in an orthogonal direction to the axial direction.

In addition, in this pilot solenoid valve, a pilot valve with a pilot manual operation button that switches the communication between the channels to the pilot valve when pressed, and a manual press section that can press and operate the pilot manual operation button when externally pressed are provided at the position on the waterproof cover section corresponding to the pilot manual operation button.

In the pilot solenoid valve with the above configuration, since the main valve and the solenoid-driven pilot valves are independently installed on the manifold base so as to be separated from each other, the pilot solenoid valve can be provided with a waterproof function using a simple structure by covering with a waterproof cover only the pilot valves that have an electrical section and the energization system.

Furthermore, it is unnecessary to remove the waterproof cover to disable the waterproof function even when conducting maintenance or inspection of those parts which do not require a waterproof function as in the case where the overall solenoid valve, including a large number of main valves arranged on the manifold bases, is covered to make it waterproof, and the maintenance or inspection of these parts can be carried out independently of the waterproofed section. At the same time, the maintenance and inspection of the waterproofed section can be conducted without affecting the other waterproofed sections by removing the waterproof cover for the desired section.

Furthermore, since the installation surface for the two solenoid-driven pilot valves that drive the valve body of the main body forward or backward is provided on the manifold base, and the pilot valves installed on the installation surface and the energization system are covered with a waterproof cover, the common waterproof cover can be used for both a single solenoid valve with one pilot valve and a double solenoid valve with two pilot valves. In addition, since the manifold base includes the feeding line housing passage to the pilot valves, the energization system can be simultaneously protected from water.

In addition, in this pilot solenoid valve, since the installation surface for the two solenoid-driven pilot valves that drive the valve body of the main body either forward or backward is provided on the manifold base in the axial direction of the valve body of the main body or in an orthogonal direction to the axial direction, the pilot solenoid valve can be made compact so that it can be installed at small installation sites.

Furthermore, with this pilot solenoid valve, if the manual press section that can operate the pilot manual operation button is provided at the position on the waterproof cover corresponding to the manual operation button, the pilot manual operation button can be operated easily without disabling the waterproof function for the pilot valves when an accident such as service interruption prevents the main valve from being operated by using the pilot valves.

A further goal of this invention is to provide a pilot solenoid valve that eliminates the need to replace both main and pilot valves, that accommodates different specifications, and that allows defective parts to be repaired or replaced easily and economically.

To achieve this goal, a second aspect of the invention provides a pilot solenoid valve with a main valve for switching an output opening between supply and ejection openings, and solenoid driven pilot valves to drive the valve body of the main valve. The pilot solenoid valve axially drives the valve body of the main valve using pilot fluid supplied or ejected through the pilot valves to switch the channel between the openings for communication. On the manifold base, the pilot solenoid valve has installation surfaces on which are installed the main valve and the two pilot valves, separate from each other, supply and ejection channels for pressure fluid, aligned with the axis in which the bases are joined, an output port opening to a front end surface, passages allowing channels and port to open into the corresponding openings in the installation surface of the main valve, first and second pilot supply and ejection channels corresponding to the pilot supply and ejection openings of the valves in the installation surface for the two pilot valves, and first and second pilot output passages, one end opening into the pilot output opening in the installation surface for the pilot valves, the other opening into the fluid passage in the installation surface for the main valve.

Alternately, the manifold base may include an external pilot passage that allows pilot supply channels to open into the pilot fluid passages in the main valve installation surface, instead of, or in addition to, a first or second pilot output passage.

In the preferred embodiment of the second aspect of the invention, feeding sockets are provided for the two pilot valves, and the pilot valves each have a feeding terminal. The sockets connect to a feeding line, housed in a passage formed in the manifold base.

When the main valve is installed on the main valve installation surface for the manifold base and one or two solenoid-driven pilot valves are installed on the pilot valve installation surface, then the supply, ejection, and output openings of the main valve communicate with the pressure fluid supply and ejection channels and output port in the manifold base, and the pilot supply and ejection openings of the pilot valves communicate with the pilot supply and ejection channels. When the pilot valves operate to supply and eject pressure fluid to and from the pilot valves through the pilot supply and ejection passages in the manifold base, pilot fluid is output to the pilot valves from the pilot output channel in the manifold base to drive the main valve. If an external pilot passage is formed in the manifold base, the main valve can output an external pilot fluid.

In this pilot solenoid valve, since the main valve and the pilot valves are installed separately on the manifold base, a main valve of single or double solenoid type can be installed on the valve installation surface for the manifold base. One or two pilot valves can be installed on the pilot valve installation surface, depending on the main valve type, allowing use of either a single or double solenoid pilot solenoid valve. In addition, to change the specification of the pilot solenoid valve or for repair, the individual parts themselves are easily replaced, without replacing both main and pilot valves. In contrast to solenoid valves with pilot valves attached to a main valve, this pilot solenoid valve allows valves to be individually separated from the manifold base, allowing changes in the specification of the manual operation section that allows the valves to be manually operated during service interruption, a change in the voltage supplied to the solenoids of the pilot valves or in indicators.

Since main and pilot valves are installed separate from each other, maintenance and inspection can be done without contacting the pilot valves with electric wiring. This design not only improves safety, it reduces costs by enabling valves to be individually replaced when the specification must be changed, or if they are damaged.

If the pilot valve installation surface does not include both pilot valves—if, for example, the pilot solenoid valve is of a single solenoid type—the unused channel can be temporarily closed, using a removable plug.

In addition, by providing a feeding line storage passage along the direction of the manifolds join through which a feeding line for feeding the solenoids of the pilot valves passes, and by installing on the pilot valve installation surface feeding sockets connected to the feeding line in the feeding line storage passage, a feeding terminal can be connected to the socket simultaneously with the mounting of the pilot valves on the installation surface, enabling electricity to be easily connected and disconnected from the pilot valves.

DETAILED DESCRIPTION OF THE PREFERRED EMBODIMENTS

Figure 1:
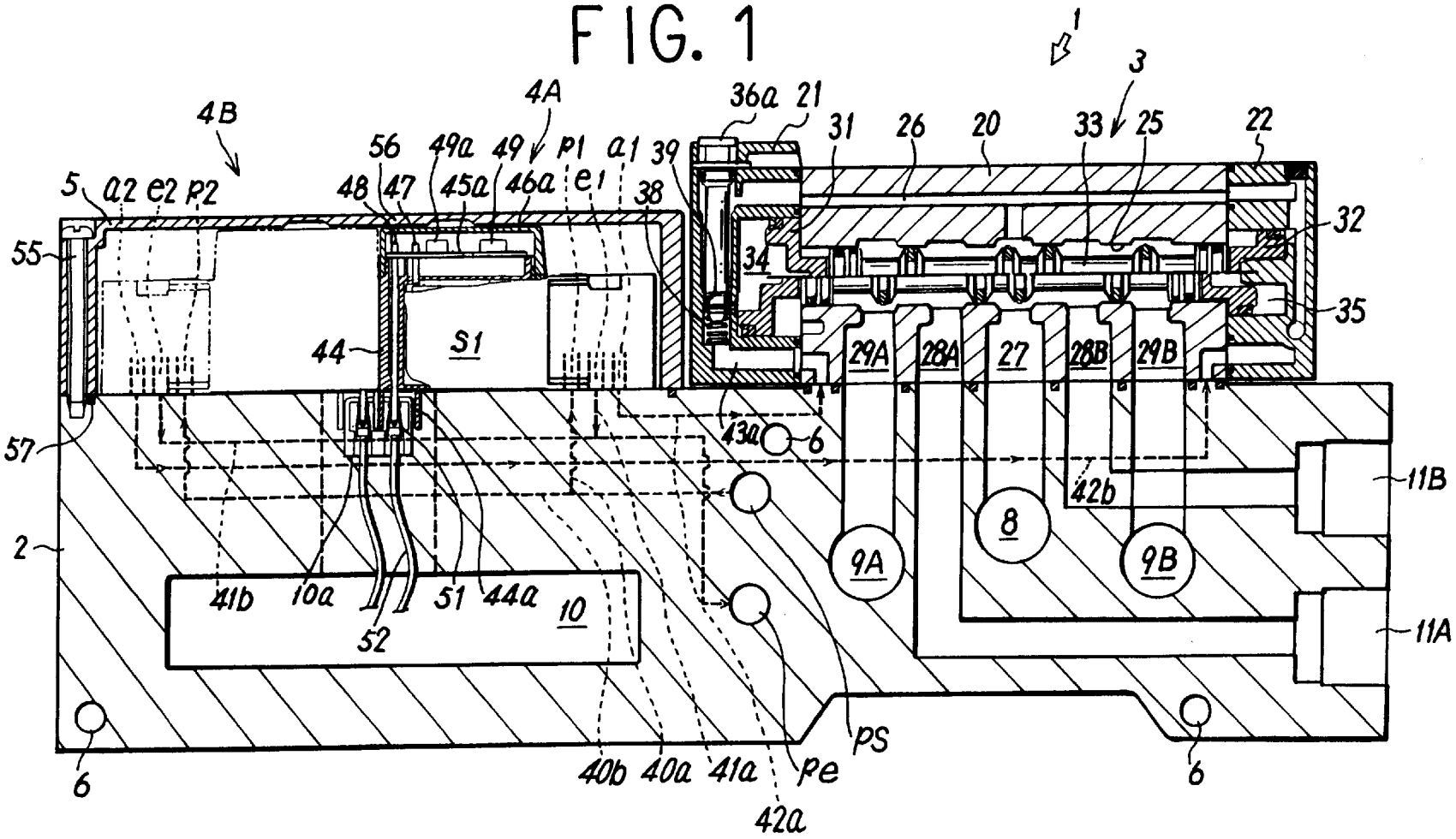
FIG. 1 is a vertical cross sectional side view showing the configuration of a first embodiment of the first aspect of the invention taken along line I—I in FIG. 2.

FIGS. 1 to 4 show a first embodiment of the first aspect of the invention, and a manifold base 2 of a pilot solenoid valve 1 has an installation surface for a main valve 3 and an installation surface for a first and second pilot valves 4A and 4B, the surfaces being separated longitudinally of the manifold base 2. In FIG. 1, a single solenoid main valve 3 is mounted on the installation surface of the manifold base 2 and a first solenoid-driven pilot valve 4A is mounted on its installation surface of the manifold base 2 (the I—I cross section in FIG. 2). Although, in FIG. 1, the second pilot valve 4B is expressed on the second pilot valve 4B installation surface by a chain line, this shows how the second pilot valve 4B is mounted when a double solenoid pilot valve 1A (see FIG. 2) is used, and the pilot valve 4B is not mounted when the single solenoid main valve 3 is used. The manifold base includes a waterproof cover 5 capable of covering both pilot valves 4A and 4B.

Figure 2:
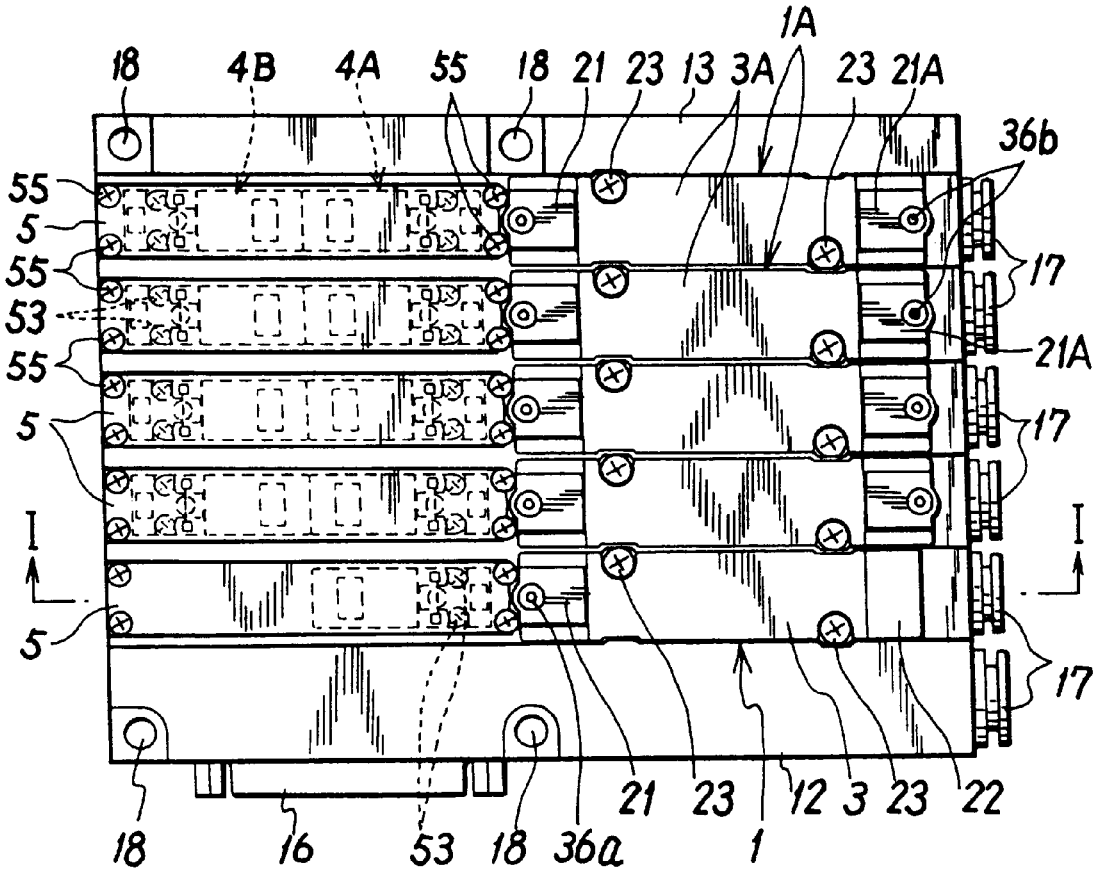
FIG. 2 is a plan view showing an implementation in which pilot solenoid valves are connected together according to this invention.
Figure 3:
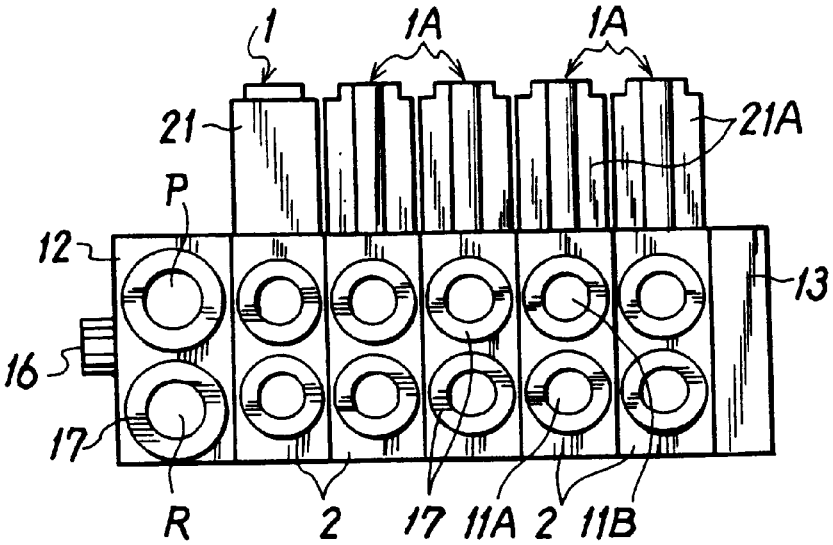
FIG. 3 is a front view of FIG. 2.

Many manifold bases 2, each including main and pilot valves, are generally connected together as shown in FIGS. 2 and 3. The manifold base 2 has a pressure fluid supply channel 8, first and second ejection channels 9A and 9B, a pilot supply channel psi and a pilot ejection channel pe, all penetrating the manifold base in the direction in which the manifold bases are connected together. It also has a wiring housing passage 10 for an energization system and a first and second output ports 11A and 11B that open to a front end surface, as shown in FIG. 1. The supply channel 8, the ejection channels 9A and 9B, and the output ports 11A and 11B open to the main valve installation surface within the top surface of the manifold bases 2. In addition, the pilot supply and ejection channels ps and pe open to the installation positions of the first and second pilot valves 4A and 4B in the pilot valve installation surface within the top surface of the manifold bases 2, and the wiring housing passage 10 is in communication with a socket-mounting section 10*a* that opens to the pilot valve installation surface via a passage.

The channels 8, 9A, and 9B that open to the main valve installation surface of the manifold base 2 are formed under the main valve installation surface, and the pilot supply and ejection channel ps and pe are formed under the main valve installation position or under the installation surface between the main valve installation position and the pilot valve installation position. Furthermore, the wiring housing passage 10 is formed under the installation surface of the pilot valves 4A and 4B. Since the manifold base 2 has few large channels under the pilot valve installation surface, a sufficient space can be obtained for the feeding line housing passage 10.

This pilot solenoid valve 1 is used so that a required number of manifold bases 2 are connected together. The manifold bases are connected together by inserting connecting bolts 14 (see FIG. 4) into the various connecting holes 6 (see FIG. 1) formed in the manifold base 2 and the connecting holes formed in the corresponding positions in a first side plate 12 at one end of the set of manifold bases and a second side plate 13 at the other end thereof.

Figure 4:
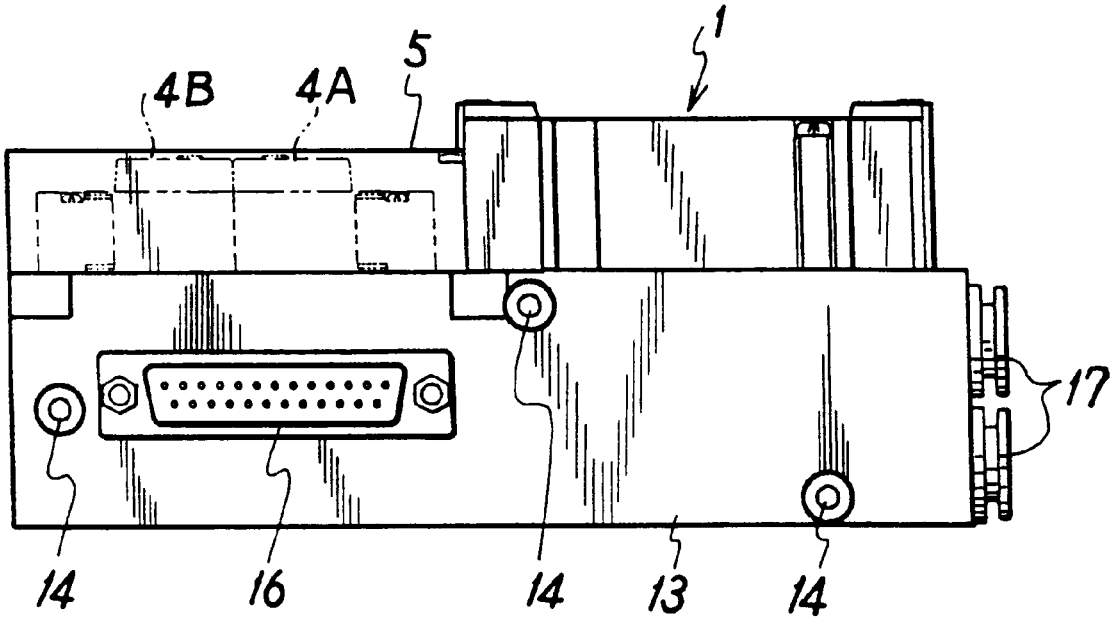
FIG. 4 is a side view of FIG. 2.

The first side plate 12 includes on its front surface a pressure fluid supply and ejection ports P and R and in a connector mounting hole formed on the outer surface, a multi-pole connector 16 that electrically connects to the solenoids of the pilot valves 4A and 4B (see FIGS. 2 to 4). The supply port P opens to the positions corresponding to the supply channel 8 and pilot supply channel ps in the manifold base 2 through the passages in the first side plate 12, and the ejection port R opens to the positions corresponding to the ejection channels 9A and 9B and pilot ejection channel pe. On the other hand, the second side plate 13 closes the other ends of these channels in the manifold base 2. Although not shown, a gasket is mounted in the connecting surfaces between the manifold base 2 and the first and second side plates 12 and 13 to allow the channels to communicate with one another in an airtight manner.

The manifold base 2 allows the single solenoid main valve 3, as shown in FIG. 1, to be installed on the main valve installation surface, and also allows a double solenoid main valve 3A (FIG. 2) to be installed. Thus, various main valves 3 and 3A can be selectively mounted when various of manifold bases 2 are connected together, as shown in FIG. 2. Of course, when the single solenoid main valve 3 is installed, only the first pilot valve 4A is installed on the pilot valve mounting surface of the manifold base 2, whereas when the double solenoid main valve 3A is installed, both the first and second pilot valves 4A and 4B are installed thereon.

A one-touch pipe joint 17 is attached to the supply and ejection ports P and R of the first side plate 12 and to the output ports 11A and 11B of the manifold base 2. When a flexible pressure fluid supply tube (not shown) is inserted into any port, the one-touch pipe joint 17 can engage the outer surface of the tube, and pressing a release bush enables the tube to be disengaged and removed.

Reference numeral 18 designates a fixation hole formed in the side plates 12 and 13, which is used to mount the pilot solenoid valve 1 on the selected members.

The single solenoid main valve 3, which is shown in detail, in FIG. 1, includes a valve body 20 and first and second piston boxes 21 and 22 located at both axial ends of the valve body 20. The piston boxes are connected to the valve body 20 with connecting screws (not shown), and these members are connected together using connecting screws (not shown) and mounted on the main valve installation surface within the top surface of the manifold base 2 via the gasket in an airtight manner, using various of mounting screws 23 (see FIG. 2).

The valve body 20 includes a valve hole 25 and a pilot passage 26 that axially penetrate the body; and a pressure fluid supply opening 27, first and second openings 28A and 28B, and first and second ejection openings 29A and 29B that are all open in the orthogonal direction to the valve hole 25. When the main valve 3 is mounted on the installation surface of the manifold base 2, these openings communicate with the corresponding channels and ports. The pilot passage 26 is in communication with the supply opening 27.

A first piston 31 is inserted into a first piston box 21 that is coaxial with the valve hole 25, a second piston 32 having a smaller diameter than the first piston (the pressure-receiving area is approximately half of the first piston) is inserted into a second piston box 22, and a valve body 33 is inserted into the valve hole 25 in such a way that these pistons and valve body can axially slide. A first pressure chamber 34 in which the first piston 31 slides is in communication with the first pilot output passage 42*a* described below, and a second pressure chamber 35 in which the first piston 32 slides is in communication with the pilot passage 26.

When pilot fluid is output to the first pressure chamber 34, the valve body 33 moves to right in the figure, and the supply opening 27 communicates with the output opening 28A, while the output opening 28B communicates with the ejection opening 29B (see the upper half of the valve body in FIG. 1). When pilot fluid is ejected from the first pressure chamber 34, the fluid that has been supplied to the second pressure chamber 35 through the pilot passage 26 moves the valve body 33 to left in the figure, and the supply opening 27 communicates with the output opening 28B, while the output opening 28A communicates with the ejection opening 29A (see the lower half of the valve body in FIG. 1). In this manner, the main valve 3 comprises five ports.

A manual operation button 36*a* capable of sliding into the first piston box 21 is normally moved upward by the force of a coil spring 38, and allows the first pilot output passage 42*a* to communicate with the first pressure chamber 34. When the button is pressed against the force of the coil spring 38, the first pressure chamber 34 communicates with the pilot channel 26, and a seal packing 39 blocks the communication between the first pressure chamber 34 and the first pilot output passage 42*a*. Thus, when an accident such as a service interruption prevents fluid from being output from the pilot valve 4A to the first pressure chamber 34, the manual operation button 36*a* can be pressed to supply pressure fluid from the pilot passage 26 to the first pressure chamber 34, thereby driving the valve body 33 to make use of the difference in diameter between the piston 31 and the piston 32.

The first pilot valve 4A includes a first pilot supply opening p1, a first pilot output opening a1, and a first pilot ejection opening e1, and also has a first solenoid s1 for driving the valve body of the pilot valve. If a second pilot valve 4B is provided, it includes second pilot supply, output, and ejection openings p2, a2, and e2, and a second solenoid s2.

These pilot valves comprise a well-known direct operated 3-port solenoid valve wherein a movable iron core (not shown) is attracted when the solenoids s1 and s2 are energized, thereby allowing the pilot supply opening to communicate with the pilot output opening, whereas the movable iron core is returned by the force of a return spring (not shown) when the solenoids s1 and s2 are de energized, thereby allowing the pilot output opening to communicate with the pilot ejection opening.

The pilot supply openings p1 and p2 and the pilot ejection openings e1 and e2 are in communication with the pilot supply and ejection channels ps and pe, respectively, through the pilot supply passages 40*a* and 40*b* and the pilot ejection passages 41*a* and 41*b*, respectively, formed in the manifold base 2.

The first pilot output opening a1 is in communication with the first pressure chamber 34 through the first pilot output channel 42*a* formed in the manifold base 2 and through the passage 43*a* formed in the valve body 20 of the main body and the first piston box 21. On the other hand, the second pilot output opening a2 opens to the top surface of the manifold base 2 near the second piston box 22 of the valve body 20 through the second pilot output passage 42*b*. In the single solenoid main valve 3, however, the communication between the second pilot output passage 42*b* and the second pressure chamber 35 is blocked in the second piston box 22.

The solenoids s1 and s2 each have a solenoid cover 44, on which substrates 45*a* and 45*b* and protective covers 46*a* and 46*b* covering those substrates are mounted. Coil terminals 47 protruding upward from the solenoids s1 and s2; and feeding terminals 48 penetrating the solenoid cover 44 downward are electrically connected to an electric circuit printed and wired in the substrates 45*a* and 45*b*, lamps 49*a* mounted on the substrates 45*a* and 45*b* indicate the energization of the solenoids s1 and s2; and electronic parts 49 required to energize the solenoids are also electrically connected to the electric circuit. Windows 56 that allow the energization of the solenoid valves s1 and s2 to be externally viewed are provided at those positions on the waterproof cover 5, which are opposed to the lamps 49*a*, and may be formed of a thin wall if the waterproof cover 5 is formed of a transparent or semi-transparent synthetic resin. If the waterproof cover 5 is formed of metal, a transparent material that allows the lamp 49*a* to be viewed must be attached to the window 56 in an airtight manner.

Sockets 51 to which the feeding terminals 48 of the first and second pilot valves 4A and 4B are connected are loaded on the socket mounting section 10*a* that opens to the pilot valve installation surface within the top surface of the manifold base 2, and the other end of a feeding terminal 52 connected to one end of the terminal connected to the socket is electrically connected to a pin in the multi-pole connector 16 through the wiring housing passage 10. The solenoid cover 44 has a positioning section 44*a* that is externally fitted to the socket 51 to allow the pilot valve to be positioned on the manifold base 2.

When the pilot valves 4A and 4B are installed on the manifold base 2 using the positioning section 44*a*, each pilot opening communicates with the corresponding pilot channel formed in the manifold base 2, and the feeding terminal 48 is inserted into the socket 51. Thus, the multi-connector 16 can feed the solenoids s1 and s2 of the pilot valves 4A and 4B together. In addition, the pilot valves 4A and 4B are mounted on the top surface of the manifold base 2 in an airtight manner by using mounting screws 53 (see FIG. 2). This prevents the feeding line 52 from being exposed through the wiring housing passage 10 formed in the manifold base 2.

The waterproof cover 5 covers the pilot valves 4A and 4B and is mounted on the top surface of the manifold base 2 via frame-like packing 57 in an air-tight manner by using mounting screws 55. Thus, if the pilot solenoid valve is used in an operation environment in which liquid such as water may splash or where humidity is high, the pilot valves 4A and 4B and the energization system extending from the feeding line 52 to the pilot valve are completely protected, thereby preventing accidents that could be caused by water. The waterproof structure consists of only the waterproof cover 5 and is very simple. Furthermore, since only the pilot valves and the energization system which require a waterproof function can be protected from water, maintenance, inspection, and replacement of the other sections can be conducted independently without disabling the waterproof function. Furthermore, a common cover can be used for a pilot solenoid valve with one or two pilot valves to allow this part to be shared by the single and double solenoid pilot valves. In addition, since the feeding line housing passage to the pilot valves is formed in the manifold base, the energization system can also be protected from water.

Although the manifold base 2 includes a supply channel 8 and ejection channels 9A and 9B, and pilot supply and ejection channels ps and pe, while are separate from the channels 8, 9A, and 9B, these pilot channels can be omitted and the pilot supply passages 40*a* and 40*b* can communicate with the supply channel 8, while the pilot ejection passages 41*a* and 41*b* can communicate with the ejection channel 9A or 9B.

In the pilot solenoid valves 1 having the above configuration, when the main valves 3 and the pilot valve 4A (and the pilot valve 4B as required) are installed on the manifold base 2, the openings of these valves communicate with the corresponding channels and ports, and the solenoids s1 and s2 of the pilot valves are electrically connected to pins in the multi-pole connector 16. In addition, when the manifold base 2 includes a waterproof cover 5, the electrical sections of the pilot valves 4A and 4B and the energization system are protected from water from the external environment.

If the single solenoid pilot valve 1 is used and the pilot valve 4B is not installed, the openings of the pilot channels 40*b* and 41*b* on the pilot valve installation surface must be closed with an appropriate means such as plugs (not shown) to prevent the flow of pilot fluid. This is also true of the following embodiments of the first aspect of the invention.

Although a detailed description is omitted to avoid redundancy, valve body 20 can include the double pilot type main valve 3A (see FIG. 2), having a second piston box 21A (with the same configuration as a first piston box 21) instead of a second piston box 22. In this case, the second piston box 21A includes a second pressure chamber 34A and a second piston 31A, both of which have diameters identical to first pressure chamber 34 and first piston 31. The second piston box 21A has a manual operation button 36*b* similar to manual operation button 36*a*. with the same effects.

In addition, this configuration requires mounting a second pilot valve 4B. A second pilot output passage 42*b* communicates with a second pressure chamber 35 through the same passage in a second piston box 21A as passage 43*a* in a first piston box 21, thereby providing pilot solenoid valve 1A with double pilot type main valve 3A (see FIGS. 2 to 4).

Figure 5:
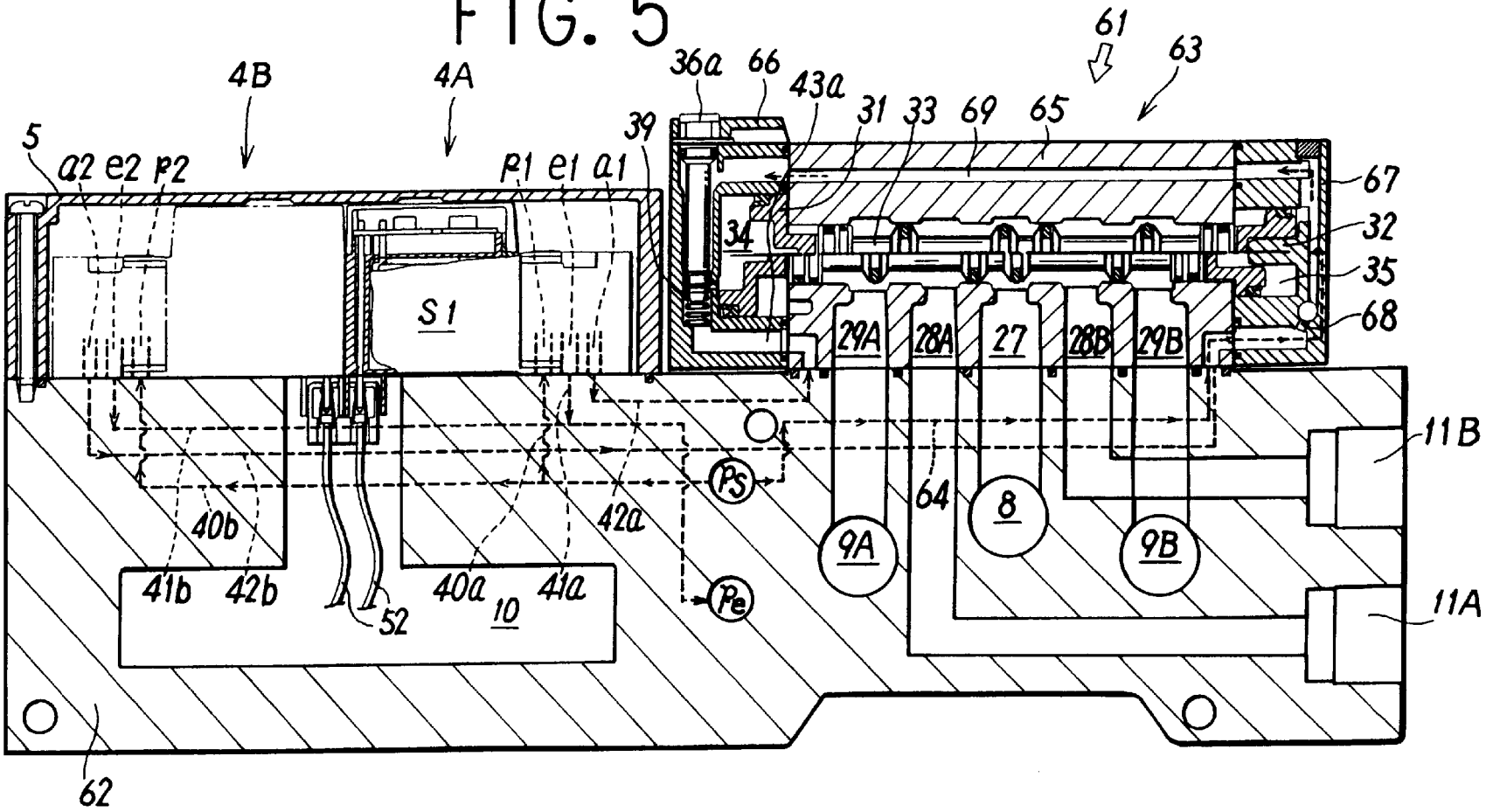
FIG. 5 is a vertical cross sectional side view showing second embodiment of the first aspect of the invention.

FIG. 5 shows a second embodiment of the first aspect of the invention. In pilot solenoid valve 61, manifold base 62 has an installation surface for main valve 73 and a different installation surface for pilot valves 4A and 4B (as in the first embodiment). Cover 5 covers all solenoid-driven pilot valves 4A and 4B separate from main valve 61. Since in the first embodiment of the first aspect of the invention, a pilot passage 64 is added to the manifold base 2, the manifold base here can be used with a main valve of a different structure.

Specifically, in the second embodiment of the first aspect of the invention, manifold base 62 of solenoid valve 61 allows for the mounting of an external pilot type main valve 63. Thus, an external pilot fluid flows through the pilot supply channel ps from a side plate similar to the first side plate 12 shown in FIGS. 2 and 3. The side plate does not allow the pilot supply channel ps to communicate with supply port P.

Manifold base 62 has a configuration similar to that of the first embodiment of the first aspect of the invention, but in addition includes external pilot channel 64, one end of which communicates with pilot supply channel ps.

Main valve 63 includes valve body 65 and has piston boxes 66 and 67 at either axial end, and the other end of the external passage 64, one end of which communicates with the pilot supply channel ps, communicates with the second pressure chamber 35 in which the second piston 32 slides, through a passage 68 formed in the valve body 65 and the second piston box 67, and is also in communication with a pilot passage 69 formed in the valve body 65, via the second pressure chamber 35. But communication between second pilot output passage 42*b* and second pressure chamber 35 is blocked in second piston box 67.

Since manifold base 62 of the pilot solenoid valve 61 in the above configuration is identical to manifold base 2 in the first embodiment of the first aspect of the invention, except for the external pilot passage 64 (one end of which communicates with the pilot supply channel ps), it can be made of the same material as manifold base 2, permitting it to be used interchangeably in piston boxes 66 and 67. This is also true of pilot valve 4A and the water-proof cover 5 covering it. Therefore, this facilitates the specification change from an internal pilot type to an external pilot type, and reduces costs by sharing the parts.

FIG. 5 shows the installation position of the second pilot valve 4B using a chain line, but it need not be mounted, since pilot solenoid valve 61 enables a pilot fluid to be supplied continuously from pilot supply channel ps to second pressure chamber 35.

The other configuration of the above pilot solenoid valve 61 is almost the same as that of the pilot solenoid valve 1 in the first embodiment of the first aspect of the invention. Thus, a detailed description is omitted. Main components have the same reference numerals.

In solenoid valve 61, according to the second embodiment of the first aspect of the invention, when the manual operation button 36*a* is pressed, the pilot fluid in external pilot passage 64 flows to first pressure chamber 34 in the first piston box 66 through passage 68 and pilot passage 69. The seal packing 39 blocks communications between the first pressure chamber 34 and the first pilot output passage 42*a*, thereby moving the valve body 33 to the right in the figure, due to the difference in diameter between piston 31 in the first piston box 66 and piston 32 in the second piston box 67, as shown in the upper half of valve body 33 in FIG. 5. When manual operation button 36*a* is released, the pilot fluid in the first pressure chamber 34 flows outside, forcing the external pilot fluid supplied to second pressure chamber 35 to move valve body 33 left in the figure (see the lower half of valve body 33 in FIG. 5).

The other effects of the second embodiment are almost the same as those of solenoid valve 1 in the first embodiment of the first aspect of the invention, so a detailed description is omitted.

Figure 6:
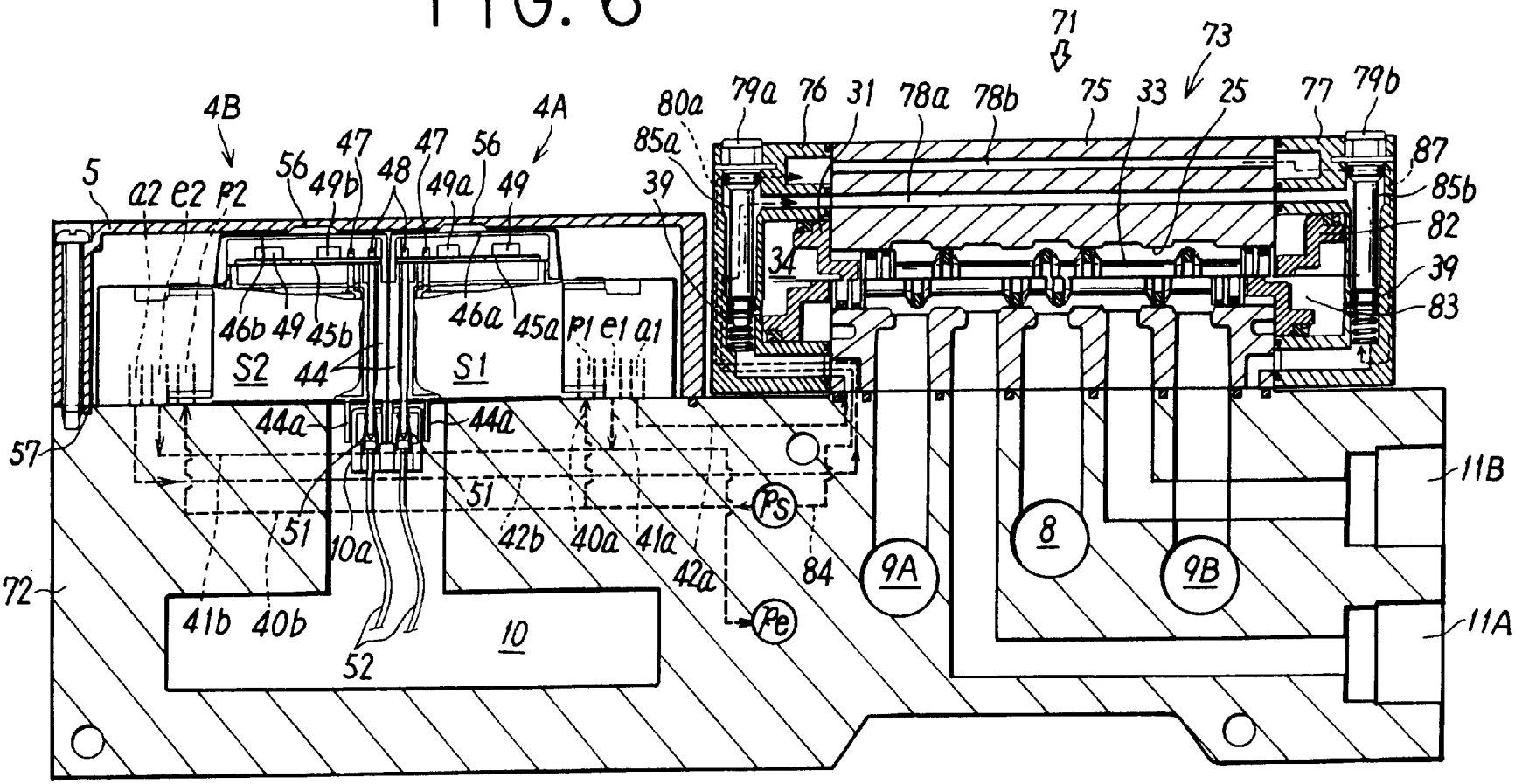
FIG. 6 is a vertical cross sectional side view showing a third embodiment of the first aspect of the invention.

FIG. 6 shows a third embodiment of the first aspect of the invention. In pilot solenoid valve 71, the pilot passages in a manifold base 72 collectively open to a first piston box 76 in a valve body 75. The manifold base to this embodiment differs from those in the first and second embodiments and requires a compatible main valve 73. Nevertheless, since the basic configuration is the same as in the first and second embodiments, the manifold bases 2, 62, and 72 can be formed of the same material and differentiated through slight modifications for the locations and number of pilot passages. In addition, when manifold bases are joined as shown in FIGS. 2 and 3, all types can be mixed as appropriate.

The third embodiment of the first aspect of the invention includes the manifold base 72, the double pilot type main valve 73 and pilot valves 4A and 4B, all mounted on the installation surfaces individually provided on base 72. The pilot valves 4A and 4B are covered with waterproof cover 5.

Main valve 73 includes a valve body 75 and first and second piston boxes 76 and 77 at either end. Valve hole 25 and first and second pilot passages 78*a* and 78*b* are axially formed in valve body 75. First piston box 76 includes first piston 31, first pressure chamber 34 and first manual operation button 79*a*. Second piston box 77 includes second piston 82 (with the same diameter as first piston 31), second pressure chamber 83 and second manual operation button 79*b*, which has the same configuration as first manual operation button 79*a*.

For the sake of illustration, pilot channels 78*a* and 78*b* in FIG. 6 are arranged vertically above valve hole 25, but these pilot channels may be formed in the dead space diagonally above the valve hole 25, parallel to a perpendicular to the plane of the figure.

Formed in manifold base 72, external pilot channel 84 and first and second pilot output channels 42*a* and 42*b* all open to the first piston box in main valve 73. As in the first embodiment, pilot output channel 42*a* communicates with the first pressure chamber 34, while second pilot output channel 42*b* communicates with second pilot channel 78*b* in valve body 75 through a passage 80*a*, formed in first piston box 76. In addition, external pilot passage 84 communicates with first pilot passage 78*a* through a passage to insertion hole 85*a* of first manual operation button 79*a* and the gap in the insertion hole 85*a*. But when the first manual operation button is not pressed, the seal packing 39 in the first manual operation button 79*a* blocks communication with first pressure chamber 34.

The other end of second pilot passage 78*b*, which communicates with the second pilot output passage 42*b*, also communicates with second pressure chamber 83 through a passage 87 formed in second piston box 77. The other end of first pilot passage 78*a* communicates with the gap in the insertion hole 85*b* of second manual operation button 79*b*, but under the illustrated conditions, the seal packing 39 in second manual operation button 79*b* blocks communication with second pressure chamber 83.

The other configuration of the third embodiment resembles the first embodiment, except for second pilot valve 4B, so a detailed description is omitted. Main components have the same reference numerals.

In the pilot solenoid valve, according to the third embodiment, when pilot valve 4A is operated to supply pilot fluid to first pressure chamber 34, valve body 33 moves to the right of the figure, switching the channel (see the upper half of the valve body in FIG. 6). When operation of the first pilot valve 4A is stopped to eject pilot fluid from the first pressure chamber 34, and second pilot valve 4B is operated to supply pilot fluid to second pressure chamber 83, valve body 33 moves to the left of the figure (see the lower half of the valve body in FIG. 6).

If an accident occurs, such as a service interruption, while first manual operation button 79*a* is pressed, external pilot passage 84 communicates with first pressure chamber 34, and seal packing 39 blocks communication between first pressure chamber 34 and the first pilot output passage 42*a*, causing the external pilot fluid to flow into the first pressure chamber 34. This in turn moves valve body 33 to the right of the figure. When first manual operation button 79*a* is released and second manual operation button 79*b* is pressed, pilot fluid in first pressure chamber 34 flows outside. External pilot passage 84 and the first pilot passage 78*a* then communicate with second pressure chamber 83 through the gap in insertion hole 85 in second manual operation, button 79*b*, outputting pilot fluid to the second pressure chamber 83 and moving valve body 33 to the left of the figure. In this case, seal packing 39 blocks communication between second pressure chamber 83 and passage 87.

Figure 7:
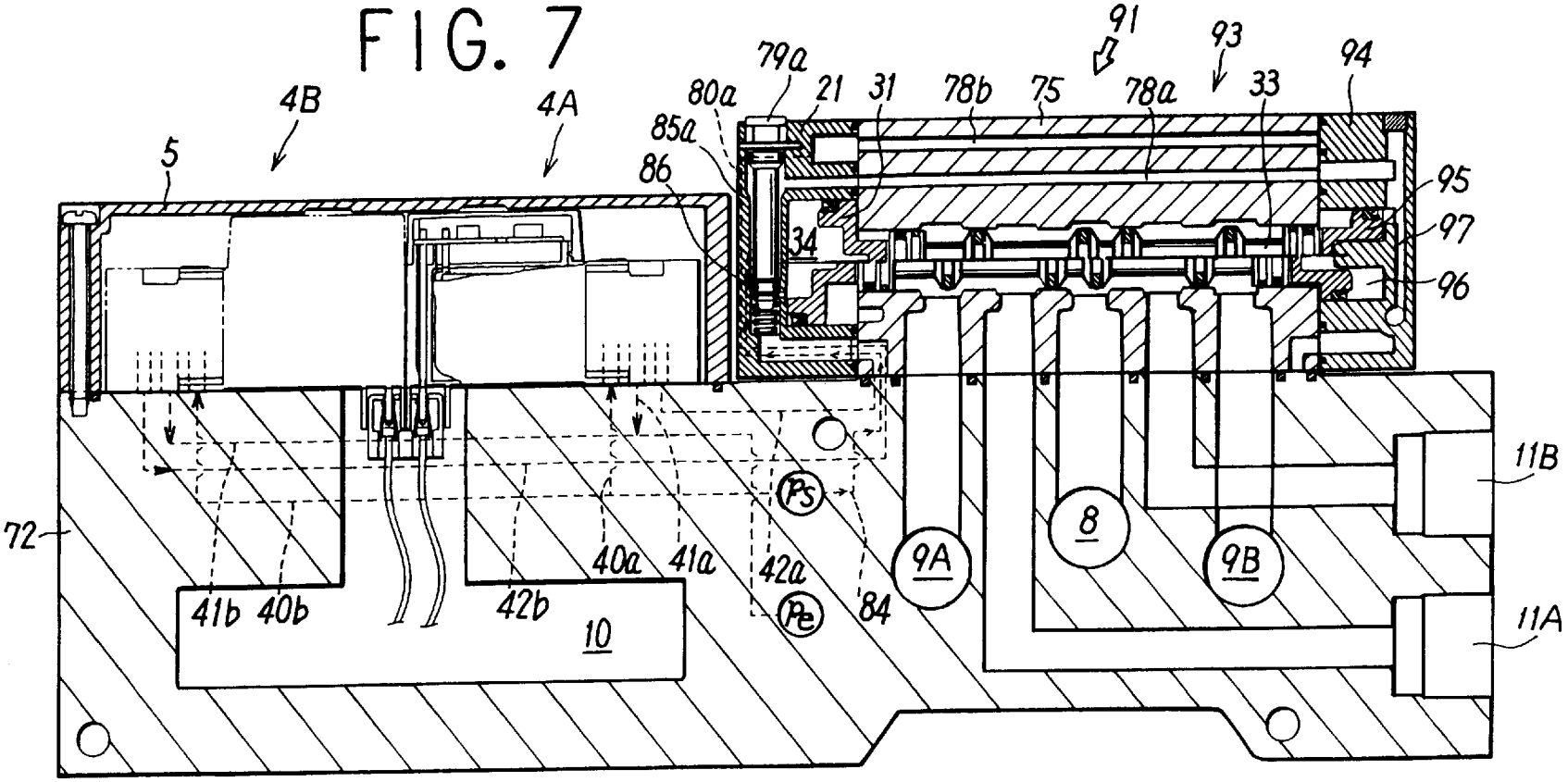
FIG. 7 is a vertical cross sectional side view showing a variation of the third embodiment of the first aspect of the invention.

FIG. 7 illustrates a case in which single solenoid pilot valve 91 is mounted instead of pilot solenoid valve 71, according to the third embodiment.

Although second piston box 94 in a main valve 93 of pilot solenoid valve 91 has a second piston 95 and a second pressure chamber 96 with smaller diameters than first piston 31 and first pressure chamber 34, and although valve body 75 is the same as in the third embodiment, the first pilot passage 78*a* communicates with second piston chamber 96 through passage 97, and the end of the second pilot passage 78*b* close to the second piston box 94 is closed by second piston box 94.

The other configuration of pilot solenoid valve 91 resembles the third embodiment except for second pilot valve 4B. Pilot solenoid valve 91 has the same effects as pilot solenoid valve 1 in the third embodiment, except for constant application of external pilot fluid pressure to pressure chamber 96. Main components have the same reference numerals, therefore, a description is omitted.

Figure 8:
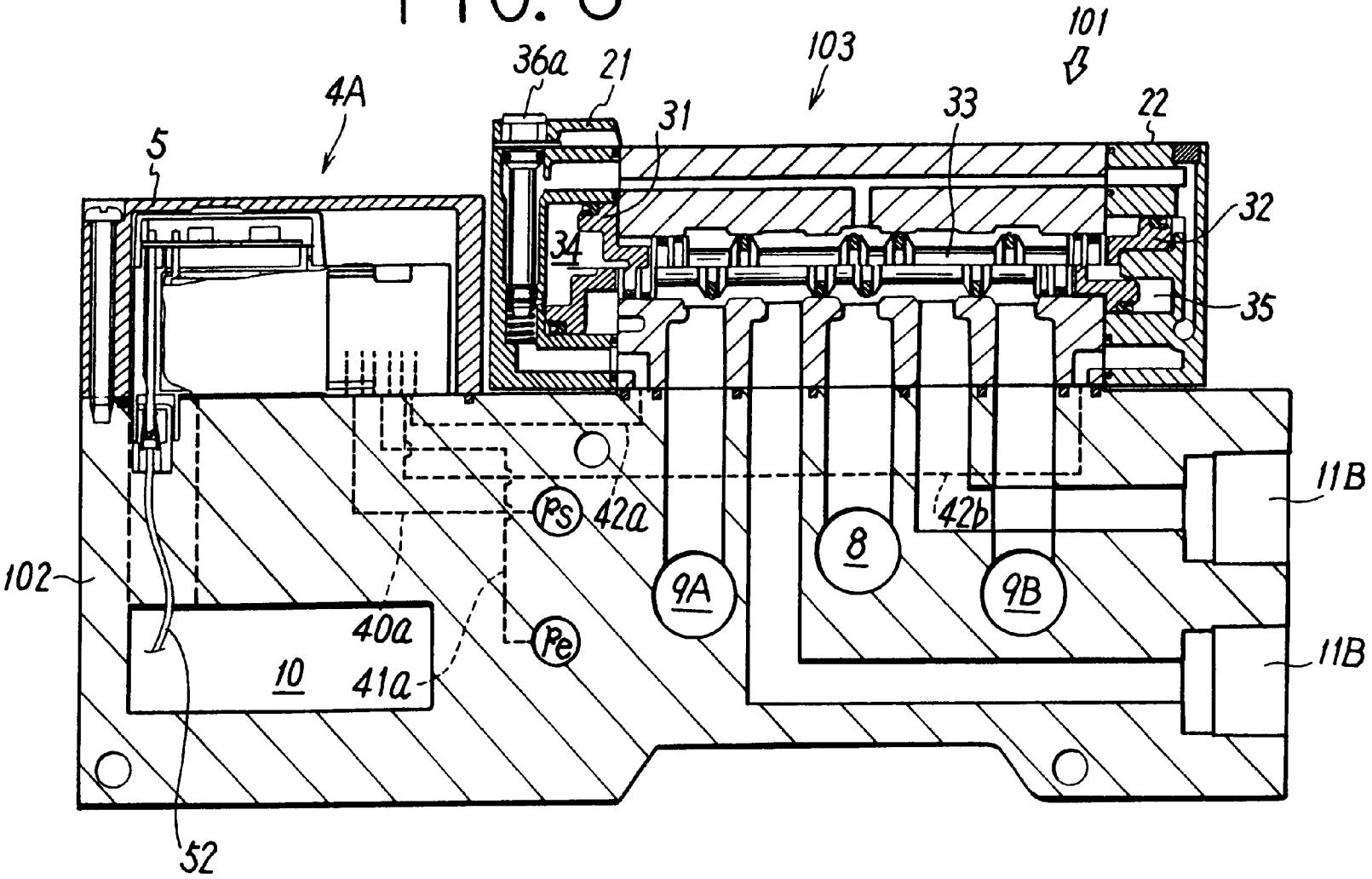
FIG. 8 is a vertical cross sectional side view showing a fourth embodiment of the first aspect of the invention.
Figure 9:
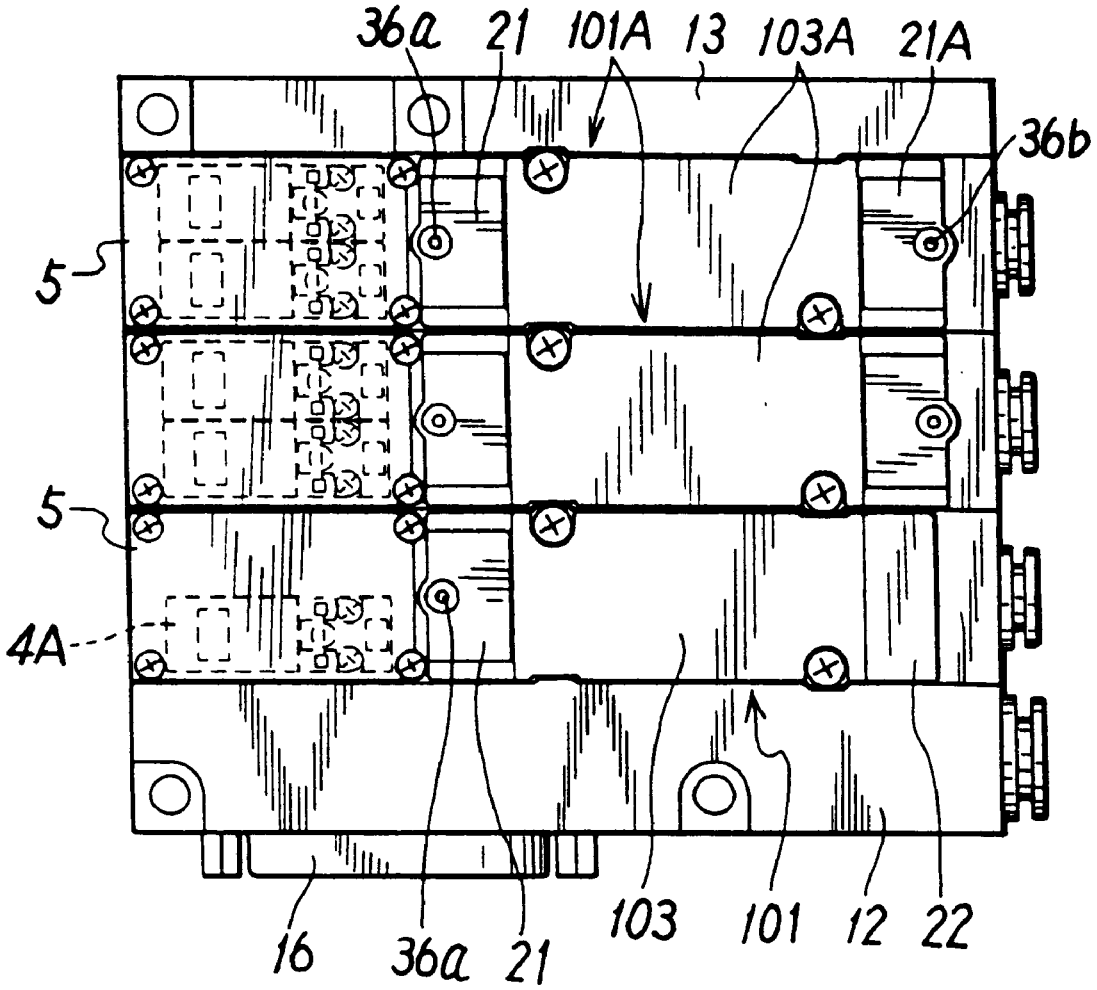
FIG. 9 is a plan view of FIG. 8.

Each of the embodiments of the first aspect of the invention described above shows a case in which the main valve and two pilot valves are positioned on the installation surface of the manifold base in series. FIGS. 8 and 9 show a fourth embodiment of the first aspect of the invention in which the two pilot valves are positioned in parallel. A pilot solenoid valve 101 in FIG. 8 includes a single pilot type main valve 103 and pilot valve 4A, whereas pilot solenoid valve 101A in FIG. 9 includes a double pilot type main valve 103A and pilot valves 4A and 4B. In pilot solenoid valves 101 and 101A, pilot valves 4A and 4B are placed on the installation surface of manifold base 102 in the direction in which the manifolds bases connect, as shown in FIG. 9.

Main valve 103 shown in FIGS. 8 and 9 has the same configuration as main valves 3 in the first embodiment, but may be of the single pilot type described in the other embodiments of the first aspect of the invention. The main valve 103A may be configured as the double solenoid type described in any or the above embodiments of the first aspect of the invention. Solenoid valves 101 and/or 101A can be joined, as shown in FIG. 9. In this case, if the main valve shown in FIG. 6 or 7 is used, manifold base 102 must include pilot passages compatible with the main valve.

In the pilot solenoid valve according to the fourth embodiment of the first aspect of the invention, the pilot valves 4A and 4B are installed on the installation surface in parallel in the direction of the width of the main valve. Nevertheless, this configuration permits increasing the diameters of valve hole 25 and valve body 33 of the main valve and consequently the flow through these valves. This configuration reduces the longitudinal length of the manifold base, despite somewhat wider width in the direction in which the manifold bases join.

The other configuration and effects of the fourth embodiment are the same as in either the first or third embodiment. A description is omitted.

Figure 10:
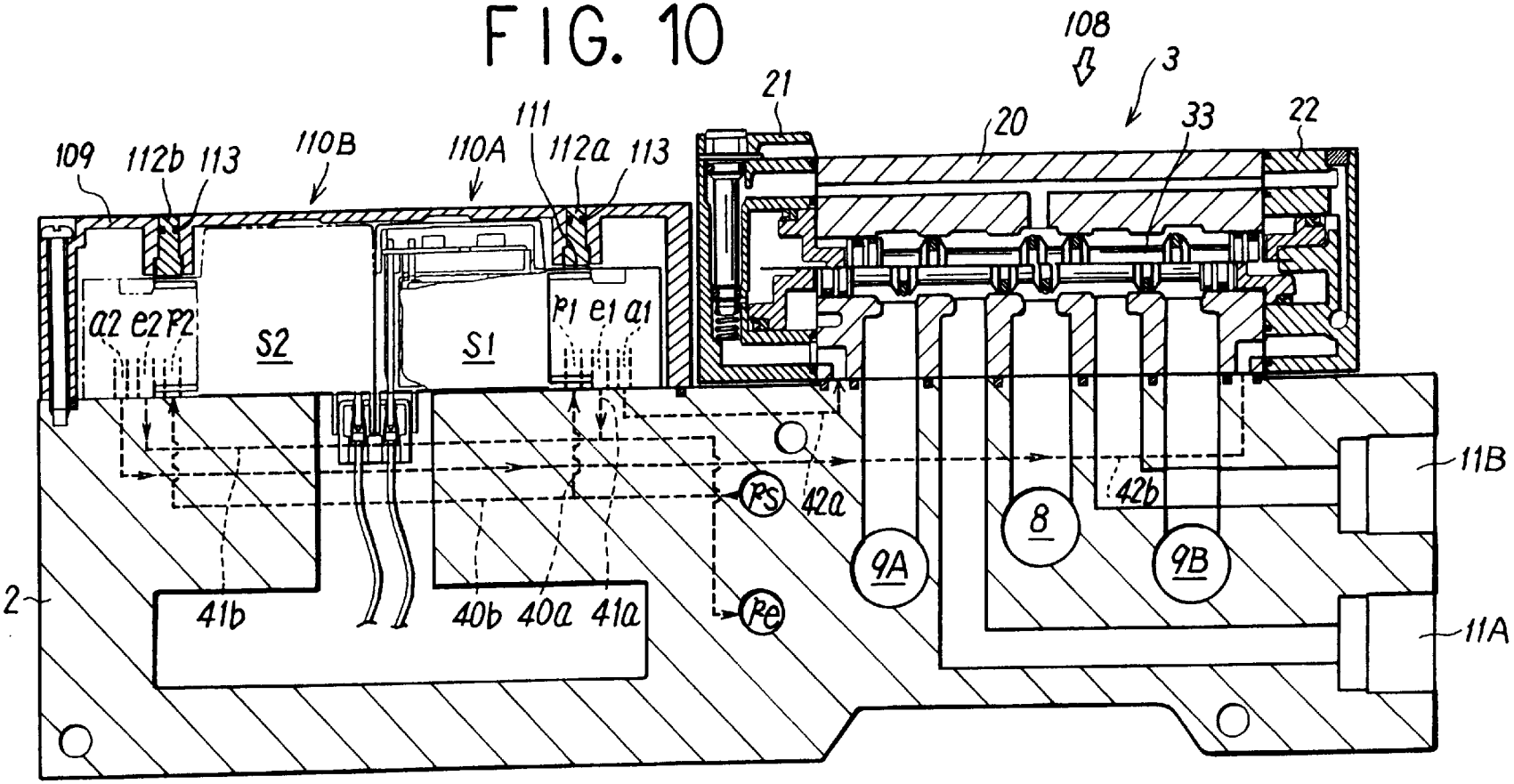
FIG. 10 is a vertical cross sectional side view showing a fifth embodiment of the first aspect of the invention.

FIG. 10 shows a fifth embodiment of the first aspect of the invention of this invention. In this embodiment, manifold base 2 of pilot solenoid valve 108 includes an installation surface for main valve 3, and as in each of the above embodiments, a different installation surface for pilot valves 110A and 110B. It also includes a waterproof cover 109 that covers both pilot valves. FIG. 10 shows the pilot valve 110B, but this is only intended to show its installation position. The main valve 3 shown in this figure does not require pilot valve 110B.

The pilot valves 110A and 110B used in this embodiment include a pilot manual operation button 111. This is a well-known operation button, pressed when an accident prevents the main valve from being operated by pilot valves 110A and 110B to move the iron core in the pilot valve and to allow pilot supply openings p1 and p2 to communicate with pilot output openings a1 and a2. This action outputs pilot fluid to the pilot output passage. When the operation button is released, it is returned by a return spring to allow pilot output openings a1 and a2 to communicate with pilot ejection openings e1 and e2.

At the position corresponding to pilot manual operation button 111, the waterproof cover 109 has a manual operation section 112*a* or 112*b* that presses and operates pilot manual operation button 111. Manual operation section 112*a* or 112*b* is made up of a push button that penetrates waterproof cover 109. On its outer circumference, a seal member 113 is mounted to form a seal against the button insertion space in waterproof cover 109. This prevents moisture from entering the waterproof cover and enables the pilot manual operation button to be operated without disabling the waterproof function for the pilot valves, even when an accident prevents the main valve from being operated by the pilot valves.

According to the fifth embodiment, the main valve and manifold base may be any of the main valves and manifold bases shown in the first through fourth embodiments of the first aspect of the invention. The other configuration and effects of the fifth embodiment are the same as in the first embodiment. The main components have the same reference numerals, and a description is omitted.

Through the design of the pilot solenoid valve, since the main and solenoid-driven pilot valves are installed to be separate from each other and the pilot solenoid valve includes a water-proof cover that covers the pilot valves and the energization system, extending from the feeding line to the pilot valve, only the pilot valves and the energization system can be protected from water with a simple waterproof cover. Since only the pilot valves and the energization system are protected, maintenance, inspection, and replacement of other sections can be done without disabling waterproofing for that section. In addition, the common cover can be used for a pilot solenoid valve with one or two pilot valves.

At the position corresponding to the pilot manual operation button for the pilot valve, when the waterproof cover has a manual operation section that presses and operates the operation button, the operation button can be operated without disabling the waterproofing for the pilot valves.

Figure 11:
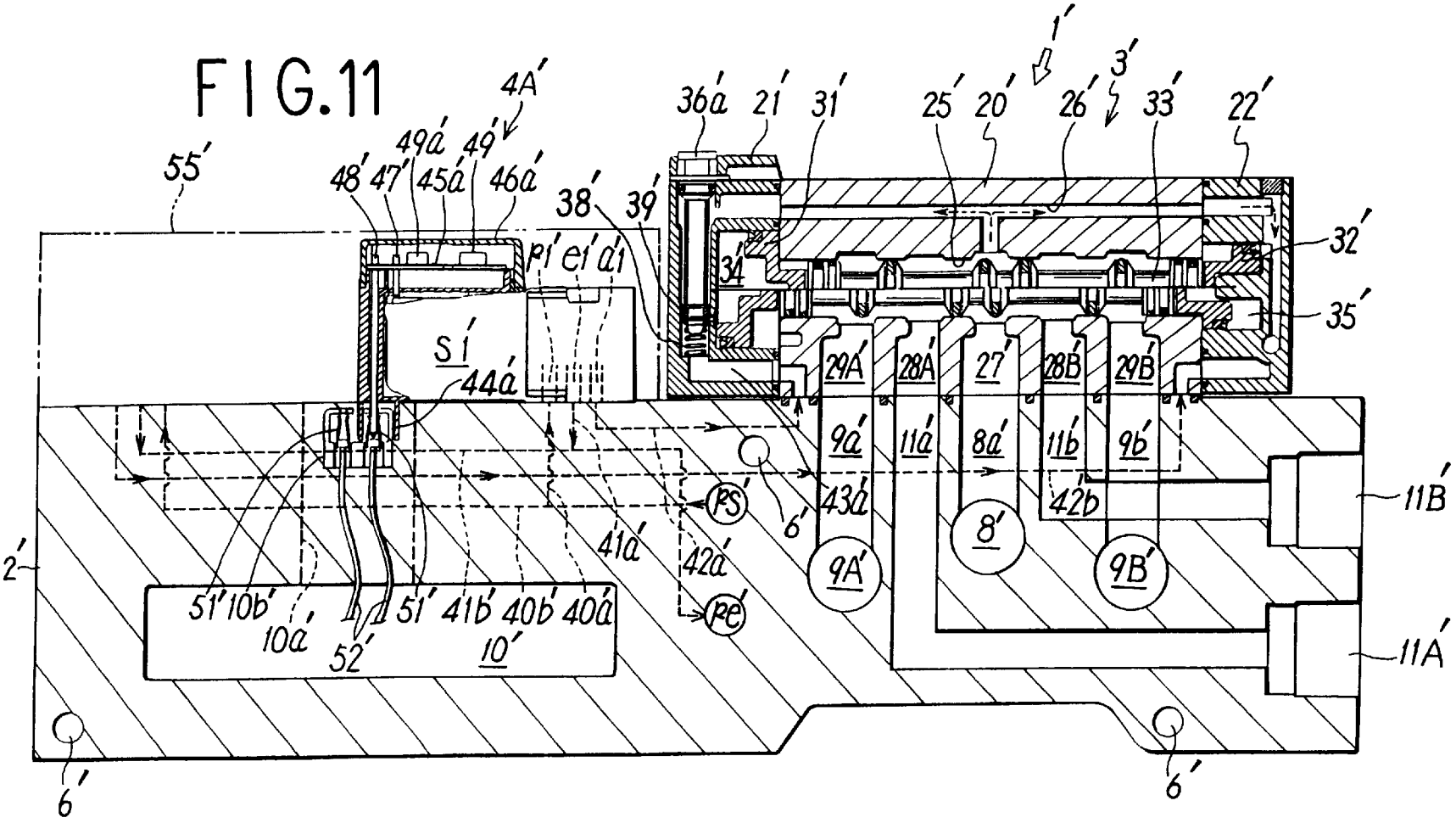
FIG. 11 is a vertical cross sectional side view that illustrates the configuration of a first embodiment of the second aspect of the invention taken along the line I—I in FIG. 13.
Figure 12:
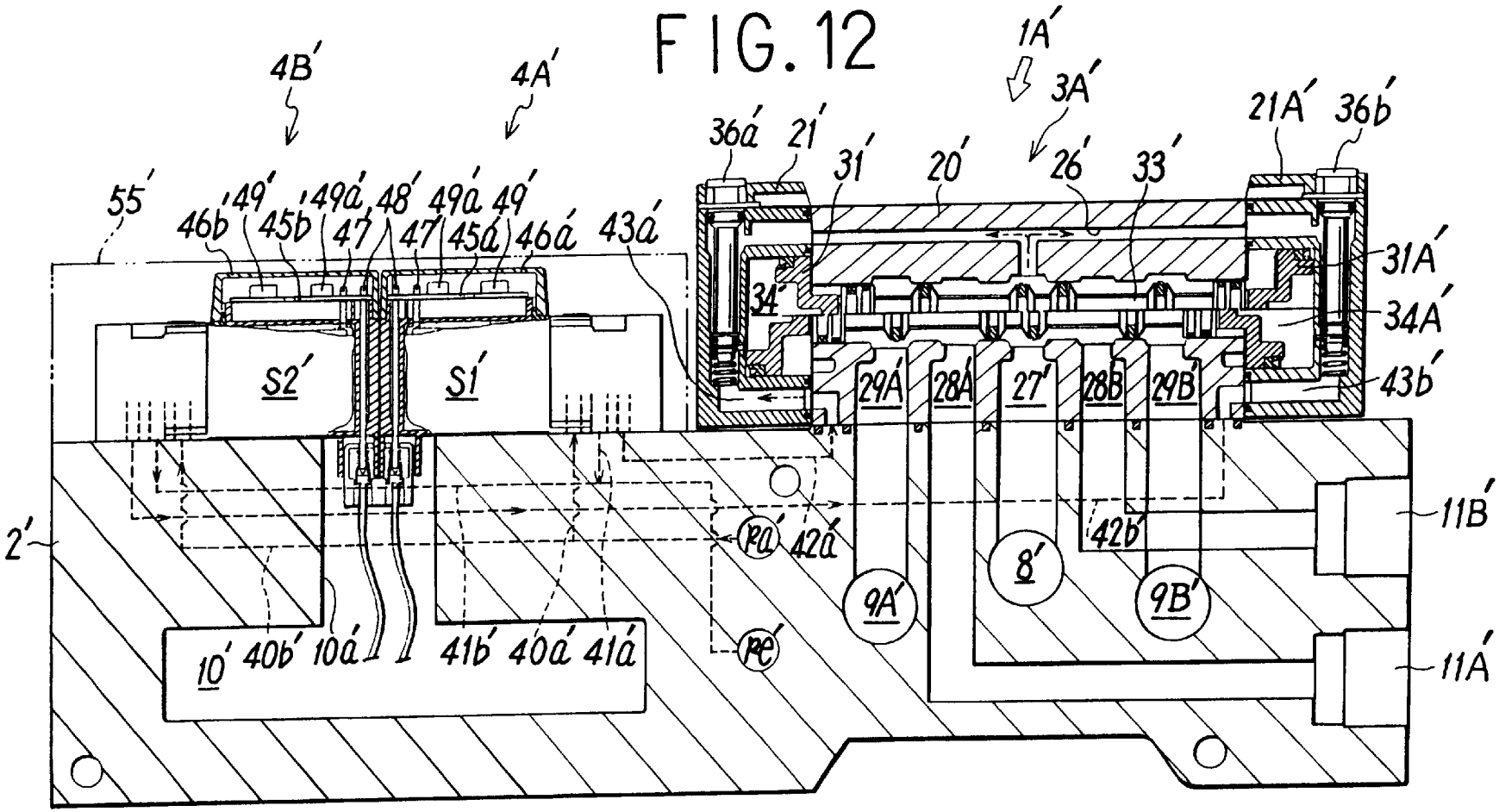
FIG. 12 is a vertical cross sectional side view showing a variation of the first embodiment of the second aspect of the invention taken along line B—B.

FIGS. 11 to 15 show a first embodiment of the second aspect of the invention of this invention. Manifold base 2 of pilot solenoid valve 1' (detailed illustration in FIG. 11) has an installation surface for main valve 3' or 3A' (FIG. 12) and an installation surface for first and second pilot valves 4A' and 4B' (FIG. 12). The surfaces are separated longitudinally. In FIG. 11, single solenoid main valve 3' and first solenoid-driven pilot valve 4A' are shown individually mounted on their respective installation surfaces (the I—I cross section in FIG. 13). In FIG. 12, double solenoid main valve 3A' is mounted on the same-structured manifold base 2' as in FIG. 11 and first and second pilot valves 4A', 4B' are mounted on the pilot valve installation surface (the B—B cross section in FIG. 13).

Figure 13:
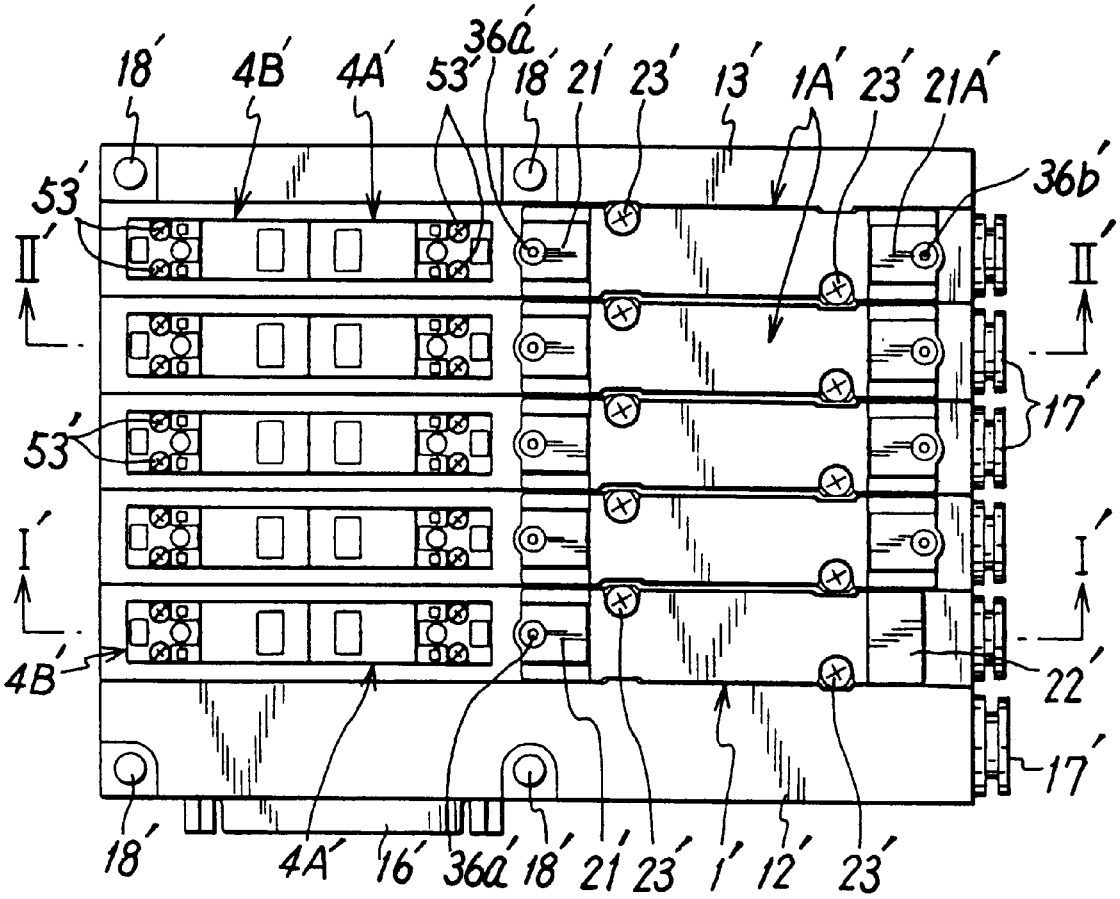
FIG. 13 is a plan view showing an implementation in which pilot solenoid valves are joined.
Figure 14:
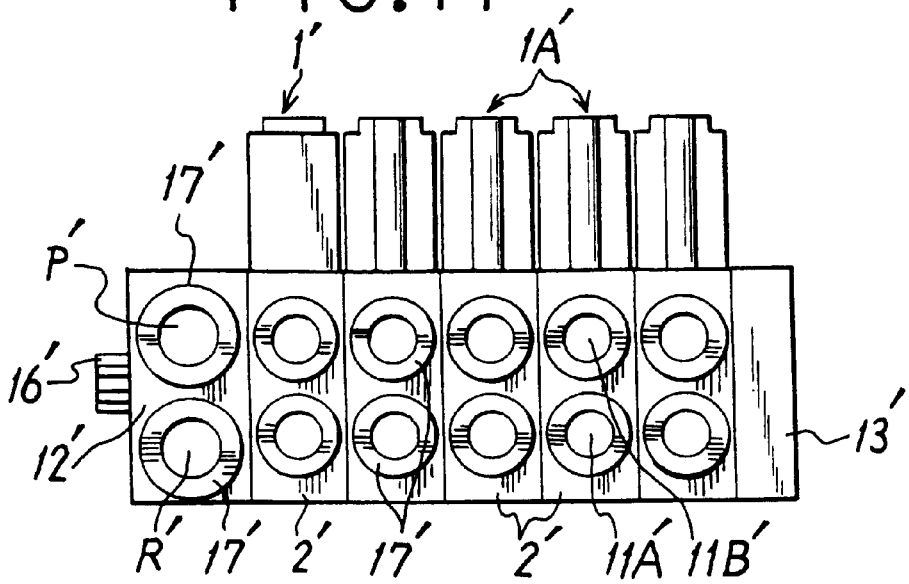
FIG. 14 is a front view of FIG. 13.
Figure 15:
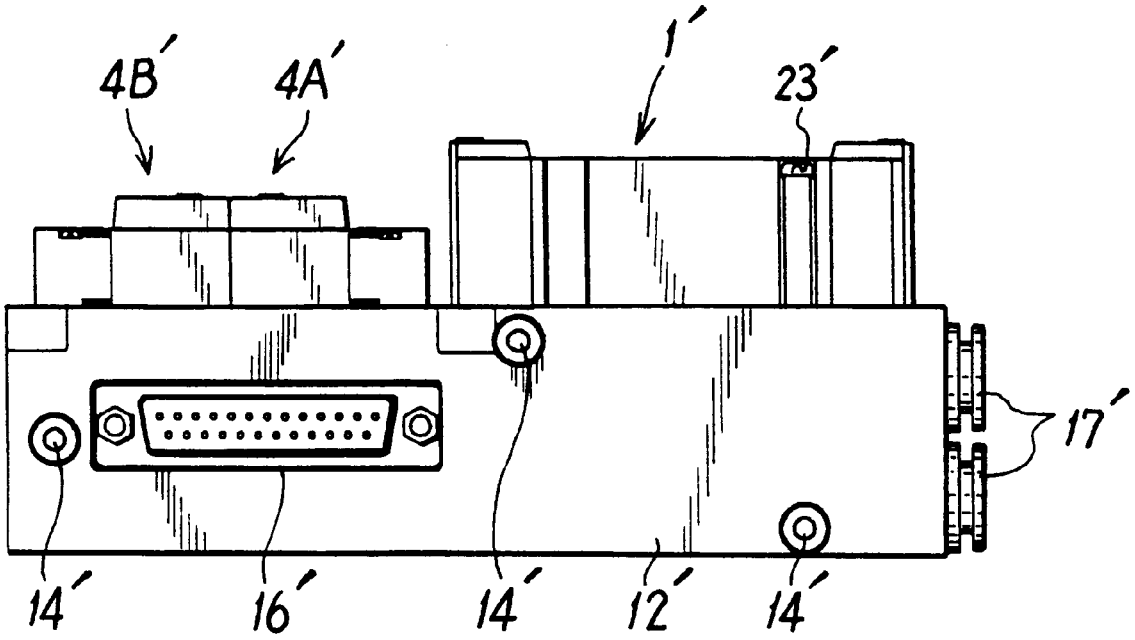
FIG. 15 is a side view of FIG. 13.

FIGS. 13 and 14 show several joined manifold bases 2', each including main and pilot valves. A manifold base 2' has a pressure fluid supply channel 8', first and second ejection channels 9A' and 9B', pilot supply channel ps', and pilot ejection channel pe'. As shown in FIGS. 11 and 12, all channels run through the manifold base along the axis along which the bases are connected. Manifold base 2' also houses a wiring housing passage 10' for an energization system, and first and second output ports 11A' and 11B' opening to a front end surface. Supply channel 8', ejection channels 9A' and 9B', and output ports 11A' and 11B' open to the main valve installation surface within the top surface of the manifold bases 2' via passages, 8*a*', 9*a*', 9*b*', 11*a*', and 11*b*'. Within the top surface of manifold base 2', pilot supply and ejection channels ps' and pe' open to installation positions for first and second pilot valves 4*a*' and 4B' in the pilot valve installation surface. Wiring housing passage 10' communicates with socket mounting section 10*b*', which opens to the installation surface for the two pilot valves 4A' and 4B' via passage 10*a*'.

The channels 8', 9A', and 9B' that open to the main valve installation surface of manifold base 2' are formed under the main valve installation surface, and the pilot supply and ejection channels ps' and pe' are formed under the main valve installation position or under the installation surface between the main valve installation position and the pilot valve installation position. Wiring housing passage 10' is formed under the installation surface for pilot valves 4A' and 4B'. The manifold base has few large channels under the pilot valve installation surface, and thus sufficient space for the feeding line housing passage 10'.

Although manifold base 2' includes supply channel 8' and discharge channels 9A' and 9B', and pilot supply and ejection channels ps' and pe' separate from channels 8', 9A' and 9B', these pilot channels can be omitted, and pilot supply passages 40*a*' and 40*b*' can communicate with supply channel 8', while pilot ejection passages 41*a*' and 41*b*' can communicate with ejection channels 9A' or 9B'.

As shown in FIG. 11, manifold base 2' allows installation of single solenoid main valve 3' on the main valve installation surface. It also allows installation of a double solenoid main valve 3A' (FIG. 12). This configuration allows various main valves 3' and 3A' to be selectively mounted when a sufficient number of manifold bases 2' are joined, as shown in FIG. 13. When a single solenoid valve type main valve 3' is installed, only the first pilot valve 4A' is installed on the pilot valve mounting surface of manifold base 2'. When a double solenoid valve type main valve 3A' is installed, both first and second pilot valves 4A' and 4B' are installed.

In pilot solenoid valves 1' and 1A', a required number of manifold bases 2' are connected together. The manifold bases 2' are joined by inserting connecting bolts 14' (see FIG. 15) into connecting holes 6' of manifold base 2' and holes in corresponding positions of first side plate 12' at one end and second side plate 13' at the other end. A minimum number of manifold bases 2' required only for pilot solenoid valve 1' or 1A', however, can be connected together.

On its front surface, the first side plate 12' includes pressure fluid supply and ejection ports P' and R'. In a connector mounting hole formed in the outer surface, the plate has a multi-pole connector 16' that connects electrically to solenoids of pilot valves 4A' and 4B' (see FIGS. 13 to 15). The supply port P' opens to positions corresponding to supply channel 8' and pilot supply channel ps in manifold base 2' through passages in first side plate 12'. Ejection port R' opens to positions corresponding to ejection channels 9A' and 9B' and pilot ejection channel pe'. Second side plate 13' closes the other ends of these channels in manifold base 2'.

A gasket—which is not shown—is mounted in connecting surfaces between manifold base 2' and first and second side plates 12' and 13' to preserve an air-tight seal in the channel.

A one-touch pipe joint 17' is attached to supply and ejection ports P' and R' of first side plate 12' and to output ports 11A' and 11B' of manifold base 2'. When a flexible pressure air supply tube (not shown) is inserted into any port, the one-touch pipe joint 17' can engage the outer surface of the tube. Pressing a release bush enables the tube to be disengaged and removed.

Reference number 18' in FIG. 13 designates a fixation hole formed in the side plates 12' and 13', which is used to mount pilot solenoid valve 1' on required members.

FIG. 11 provides a detailed illustration of the single solenoid type main valve 3'. This valve consists of a valve body 20' and first and second piston boxes 21' and 22', located at either axial end of the valve body 20'. The piston boxes are connected to the valve body 20' with connecting screws (not shown), and valve body 20' is mounted on the main valve installation surface within the top surface of the manifold base 2' with an airtight gasket, using multiple mounting screws 23' (see FIG. 13).

Valve body 20' consists of a valve hole 25' and pilot passage 26', running axially through the body; a pressure fluid supply opening 27', first and second output openings 28A' and 28B' and first and second output ejection openings 29A' and 29B', all opening in a direction orthogonal to valve hole 25'. When main valve 3' is mounted on the installation surface of manifold base 2', these openings communicate with their corresponding channels and ports. Pilot passage 26' communicates with supply opening 27'.

A first piston 31' is inserted into a first piston box 21', coaxial with valve hole 25', a second piston 32' having a smaller diameter than the first piston 31' (the pressure receiving area is approximately half) is inserted into a second piston box 22' and a valve body 33' pressed by pistons 31' and 32' is inserted into valve hole 25', so that the pistons and valve body are free to slide along an axis. A first pressure chamber 34' in which first piston 31' slides communicates with first pilot output passage **42*a*' of manifold base 2'. A second pressure chamber 35' in which second piston 32' slides communicates with pilot passage 26'**.

When pilot fluid is output to first pressure chamber 34', valve body 33' moves to the right of the figure, and supply opening 27' communicates with output opening 28A', while output opening 28B' communicates with ejection opening 29B' (see the upper half of the valve body in FIG. 11). When pilot fluid is ejected from first pressure chamber 34', the fluid supplied to second pressure chamber 35' through pilot passage 26' moves valve body 33' to the left of the figure, and supply opening 27' communicates with output opening 28B', while output opening 28A' communicates with ejection opening 29A' (see the lower half of the valve body in FIG. 11). Thus described, main valve 3' has five ports.

Inserted into first piston box 21' in a way that permits it to slide, manual operation button **36*a*' is normally forced upward by coil spring 38'. It allows first pilot output passage 42*a*' to communicate with the first pressure chamber 34'. When the button is pressed against the force of the coil spring 38', the first pressure chamber 34' communicates with pilot channel 26', and a seal packing 39' blocks communication between first pressure chamber 34' and the first pilot output passage 42*a*'. Thus, when an accident such as a service interruption prevents fluid from being output from pilot valve 4A' to first pressure chamber 34', manual operation button 36*a*' can be pressed to supply a pressure fluid from pilot passage 26' to first pressure chamber 34', driving valve body 33' due to the difference in diameter between pistons 31' and 32'**.

First pilot valve 4A' includes first pilot supply opening p1', first pilot output opening a1' and first pilot ejection opening e1'. It also has first solenoid s1' for driving the valve body of the pilot valve. The first pilot valve consists of a well-known direct operated three-port solenoid valve. In this valve, solenoid s1' when energized attracts a movable iron core (not shown), allowing pilot supply opening p1' to communicate with pilot output opening a1'. When no current runs through solenoid s1', the movable iron core is returned to its position by a return spring (not shown), all owing pilot output opening a1'to communicate with pilot ejection opening e1'.

The pilot supply and ejection openings p1' and e1' of the first pilot valve communicate with pilot supply and ejection channels ps' and pe' through pilot supply and ejection passages **40*a*' and 41*a*', respectively, which are formed in manifold base 2'. The first pilot output opening a1' communicates with first pressure chamber 34' through first pilot output channel 42*a*', formed in manifold base 2', and through passage 43*a*', formed in valve body 20' of main body and first piston box 21'**.

Since manifold base 2' is used with a double solenoid pilot solenoid valve, it has an installation surface for second pilot valve 4B'. Since a second pilot valve 4B' with the same structure as the first pilot valve can be installed as shown in FIG. 12, manifold base 2' has channels similar to those for the first pilot valve.

That is, the manifold base has channels corresponding to second pilot supply, output, and ejection openings p2', a2', and e2' of the second pilot valve 4B', and the second pilot supply and ejection openings p2' and e2' communicate with pilot supply and ejection channels ps' and pe' through pilot supply and ejection passages **40*b*' and 41*b*', formed in the manifold base 2', respectively. Second pilot output opening a2' opens to the top surface of the second piston box 22' of valve body 20' in the manifold base 2', through second pilot output passage 42*b*'**.

When first and second pilot output channels **42*a*' and 42*b*' communicate in this way with pressure chambers 34' and 35' of the first and second piston boxes through valve body 20', first and second piston boxes 21' and 22' can be removed from valve body 20' for repairs or replacement while valve body 20' remains mounted on manifold base 2'**.

In the single solenoid main valve 3' in FIG. 11, communication between second pilot output passage **42*b*' and second pressure chamber 35' is blocked in the second piston box 22', closing passage 42*b*'**.

Solenoids s1' and s2' each have a solenoid cover 44', on which substrates **45*a*' and 45*b*' and protective covers 46*a*' and 46*b*' covering the substrates are mounted. Coil terminal 47' projecting upward from solenoids s1' and s2', and feeding terminal 48', penetrating the solenoid cover 44' downward, are connected electrically to an electric circuit printed and wired in substrates 45*a*' and 45*b*' and to a lamp 49*a*' mounted on substrates 45*a*' and 45*b*'** indicating energization of solenoids s1' and s2' and electronic parts 49', required to energize the solenoids, are also electrically connected to the circuit.

Sockets 51', to which feeding terminal 48' of the first and second pilot valves 4A' and 4B' are connected, are loaded on socket mounting section 10*a*', which opens to the pilot valve installation surface within the top surface of manifold base 2'. The other end of feeding line 52' that is connected to one end of the terminal connected to the socket is electrically connected through wiring housing passage 10' to a pin in multi-pole connector 16'. Solenoid cover 44' has a positioning section 44*a*' that is externally fitted to socket 51', allowing the pilot valve to be positioned on manifold base 2'.

When feeding sockets 51' are provided in this manner under the pilot valve installation surface of manifold base 2', feeding terminal 48' can be connected to socket 51' simultaneously with the mounting of the pilot valve on its installation surface, thereby allowing easy electrical connection of pilot valves 4A' and 4B'.

When pilot valves 4A' and 4B' are installed on manifold base 2' using positioning section 44*a*', each pilot opening communicates with the corresponding pilot passage in manifold base 2', and feeding terminal 48' is inserted into socket 51'. Thus, the multi-connector 16' can feed both solenoids s1' and s2' of pilot valves 4A' and 4B'. Pilot valves 4A' and 4B' are mounted on the top surface of manifold base 2' in an air-tight configuration, using mounting screws 53' (see FIG. 13). This prevents feeding line 52' from being exposed through the wiring housing passage 10' in manifold base 2'.

Pilot valves 4A' and 4B' can be covered with a waterproof cover 55', as shown in the figure by a chain line, protecting the electrically operating parts and their energization system from water. This is also true in the following embodiments of the second aspect of the invention.

In the double solenoid type pilot solenoid valve 1A' shown in FIG. 12, main valve 3A' has, on one side of valve body 20', first piston box 21' (identical to the single solenoid type main valve 3' in FIG. 11); and on the other side of valve body 20', a second piston box 21A' having the same configuration as first piston box 21'. Thus, a second pressure chamber 34A' and a second piston 31A', both provided in second piston box 21A', have the same diameters as first pressure chamber 34' and first piston 31'. They also have a manual operation button 36*b*' similar to manual operation button 36*a*'. Double-solenoid-type pilot solenoid valve 1A' includes the second pilot valve 4B', and a second pilot output passage 42*b*' communicates with second pressure chamber 34A' through passage 43*b*' in valve body 20' and the second piston box 21A'.

The other configuration of solenoid valve 1A' is identical to solenoid valve 1'. The main components have the same reference numbers; their detailed description is omitted.

In pilot solenoid valves 1' and 1A' with the above configuration, when main valves 3' and 3A' and pilot valves 4A' and 4B' are installed on manifold base 2', the openings of these valves communicate with the corresponding channels and ports, and solenoids s1' and s2' of the pilot valves are electrically connected to pins in multi-pole connector 16'.

If a single solenoid type pilot solenoid valve 1' is used and pilot valve 4B' is not installed, the openings of pilot channels 40*b*' and 41*b*' on the pilot valve installation surface must be closed with appropriate means—plugs (not shown), for example—to prevent the flow of pilot fluid. This is true of the following embodiments of the second aspect of the invention.

In the single solenoid type pilot solenoid valve 1' in FIG. 11, when solenoid s1' of the pilot valve 4A' is energized, pilot fluid flows to first pressure chamber 34' to drive the main valves 3', thereby outputting pressure fluid (such as compressed air) from the first output port 11A'. When solenoid valve s1' is de-energized, pilot fluid in first pressure chamber 34' is ejected outside, outputting pressure fluid from second output port 11B'. In pilot solenoid valve 1A', when solenoids s1' and s2' of pilot valves 4A' and 4B' are alternatively energized and de-energized, main valve 3A' ejects fluid from first and second output ports 11A' and 11B', alternately.

If an accident occurs, manual operation buttons 36*a*' and 36*b*' are used as described above.

In the pilot solenoid valve, main valves 3' and 3A' and pilot valves 4A' and 4B' are installed on manifold base 2', separate from each other, so that single or double solenoid type main valve 3' or 3A' can first be installed on the valve installation surface of manifold base 2', and one or two pilot valves can then be installed on the same surface depending on the main valve. This arrangement allows for either a single or double solenoid type pilot solenoid valve, and for the replacement of such solenoid valves. By replacing first piston 21' or second piston box 22' or 21A', the specification can be changed between the single solenoid type and the double solenoid type with valve body 20' remaining mounted on the manifold base.

To make other changes in the specification of the pilot solenoid valve or to repair or replace defective parts, only the part in question need be removed. This can be done without replacing both main and pilot valves. In contrast to conventional solenoid valves, which have a pilot valve directly attached to a main valve, this pilot solenoid valve allows main valves 3' and 3A' and pilot valves 4A' and 4B' to stand discretely on the manifold base, permitting various cost-saving changes in the manual operation section, which is operated manually in the event of service interruption, in voltage supplied to the solenoids of the pilot valves, and in indicators. The main and pilot valves are installed discretely, and this facilitates the maintenance, inspection and failure discovery In addition, maintenance and inspection of the main valve can be done without contacting pilot valves that have electric wiring. This feature improves the safety of maintenance and inspection operations.

Figure 16:
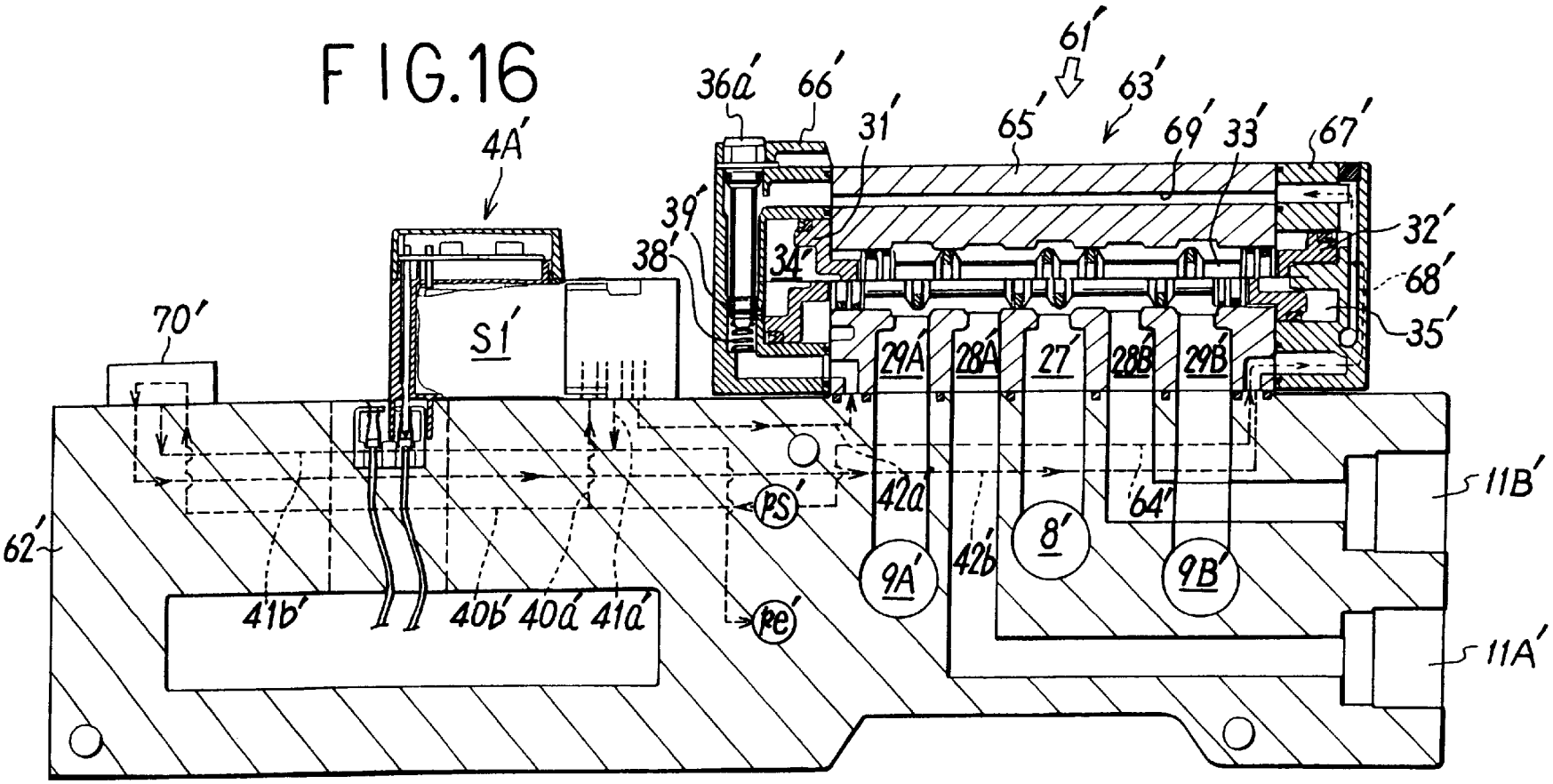
FIG. 16 is a vertical cross sectional side view showing a second embodiment of the second aspect of the invention.

FIG. 16 illustrates a second embodiment of the second aspect of the invention. A pilot solenoid valve 61' of single solenoid type includes an external pilot type main valve 63'. As in the first embodiment of the second aspect of the invention, manifold base 62' has an installation surface for main valve 63' and a separate installation surface for first and second pilot valves 4A' and 4B'. In addition to the configuration shown in FIGS. 11 and 12, manifold 62' has an external pilot passage 64', one end of which communicates with pilot supply channel ps'. Thus, an external pilot fluid flows through the pilot supply channel ps from a side plate similar to the first side plate 12' shown in FIGS. 13 and 14. The side plate does not allow pilot supply channel ps' to communicate with supply port P'.

Main valve 63' includes a valve body 65' and first and second piston boxes 66' and 67' at either axial end. The other end of external passage 64' (one end of which communicates with pilot supply channel ps') communicates with second pressure chamber 35', in which the second piston 32' slides. This communication occurs through passage 68' in valve body 65' and second piston box 67'. External passage 64' also communicates with pilot passage 69' in the valve body 65', via second pressure chamber 35'. But communication is blocked between second pilot output passage 42*b*' and second pressure chamber 35' in second piston box 67'.

In pilot solenoid valve 61', an external pilot fluid is supplied to second pressure channel 35' from pilot supply channel ps', so the installation surface for second pilot valve 4B' does not include the pilot valve.

As shown in the figure, a plug 70' that allows pilot supply passage 40*b*' to communicate with pilot output passage 42*b*' can be provided in the mounting position of second pilot valve 4B'. Or the pilot supply channel ps' can be allowed to communicate directly with pilot output passage 42*b*', in order to allow pilot output passage 42*b*' to communicate with second pressure chamber 35' in second piston box 67'.

The other configuration and effects of solenoid valve 61' are the same as those of the solenoid valve 1' in the first embodiment of the second aspect of the invention, with main components having the same reference numbers. A detailed description is omitted.

In solenoid valve 61' according to this embodiment, when the manual operation button 36*a*' is pressed, the pilot fluid in the external pilot passage 64' is supplied to first pressure chamber 34' through passage 68 and pilot passage 69', moving the valve body 33' to the right of the figure, due to the difference in diameter between piston 31' and piston 32' (see upper half of the valve body in FIG. 16). When manual operation button 36*a*' is released, pilot fluid in the first pressure chamber 34' is ejected outside, causing the external pilot fluid supplied to second pressure chamber 35' to move valve body 33' to the left of the figure (see lower half of the valve body in FIG. 16).

Figure 17:
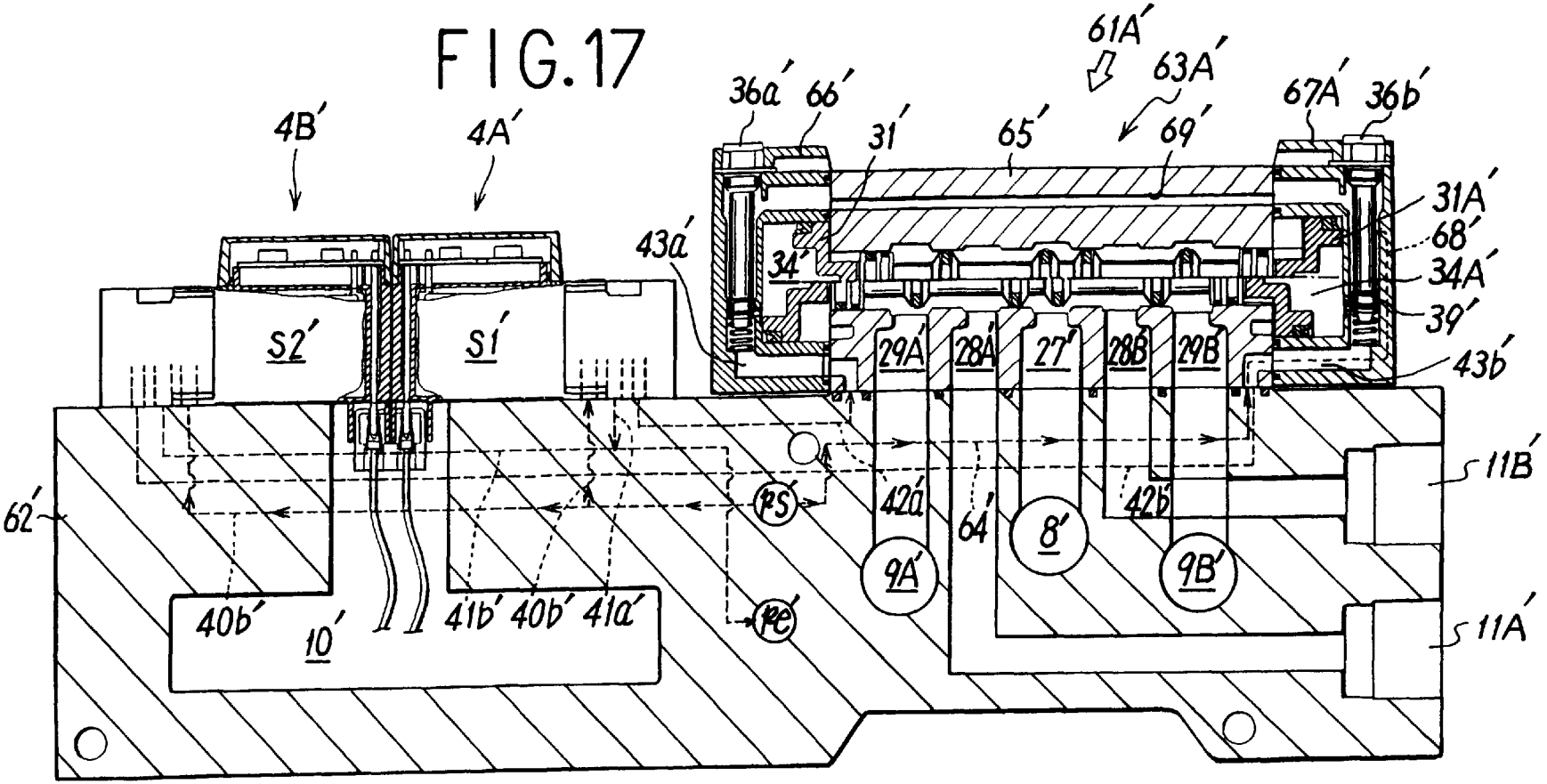
FIG. 17 is a vertical cross sectional side view showing a variation of the second embodiment of the second aspect of the invention.

FIG. 17 shows the use of a double solenoid type pilot solenoid valve 61A' instead of a single solenoid type solenoid valve 61'. In this case, manifold base 62' has the same configuration as in FIG. 16, but the two pilot valves 4A' and 4B' must be mounted on manifold base 62'. Instead of second piston box 67' in FIG. 16, a second piston box 67A' having the same configuration as first piston box 66' is mounted on one side of valve body 65' in main valve 63A'. That is, second piston box 67A' includes a second pressure chamber 34A' and a second piston 31A', which have the same diameters as first pressure chamber 34' and first piston 31', respectively. It also has a passage 43*b*' that allows second pilot output passage 42*b*' to communicate with second pressure chamber 34A'. The second piston box 67A' also has a passage 68' that allows external pilot passage 64' to communicate with pilot passage 69' and a manual operation button 36*b*' in passage 68'. However, under the conditions shown in the figure, the seal packing 39' blocks communication between passage 68' and the second pressure chamber 34A'.

The other configuration of the solenoid valve 61A' in FIG. 17 is the same as solenoid valve 61', with main components having the same reference numbers. A detailed description is omitted.

In solenoid valve 61A', when solenoid s1' of pilot valve 4A' is energized, pilot fluid flows to first pressure chamber 34'. When solenoid s2' of the pilot valve 4B' is energized, pilot fluid flows to second pressure chamber 34A'. If an accident occurs and manual operation button 36*a*' or 36*b*' is pressed, an external pilot fluid flows from passage 68' to first or second pressure chamber 34' or 34A'.

The other effects of the solenoid valve 61A' are almost identical to solenoid valve 61'. A detailed description is omitted.

The solenoid valve according to the second embodiment of the second aspect of the invention can be provided by using manifold base 2', first piston box 66', and pilot valves 4A' and 4B', or by somewhat modifying these parts. Specifications of the solenoid valves in FIGS. 11 and 12 can be adapted to an external pilot type, and these solenoid valves can be configured at low cost by using common parts.

Figure 18:
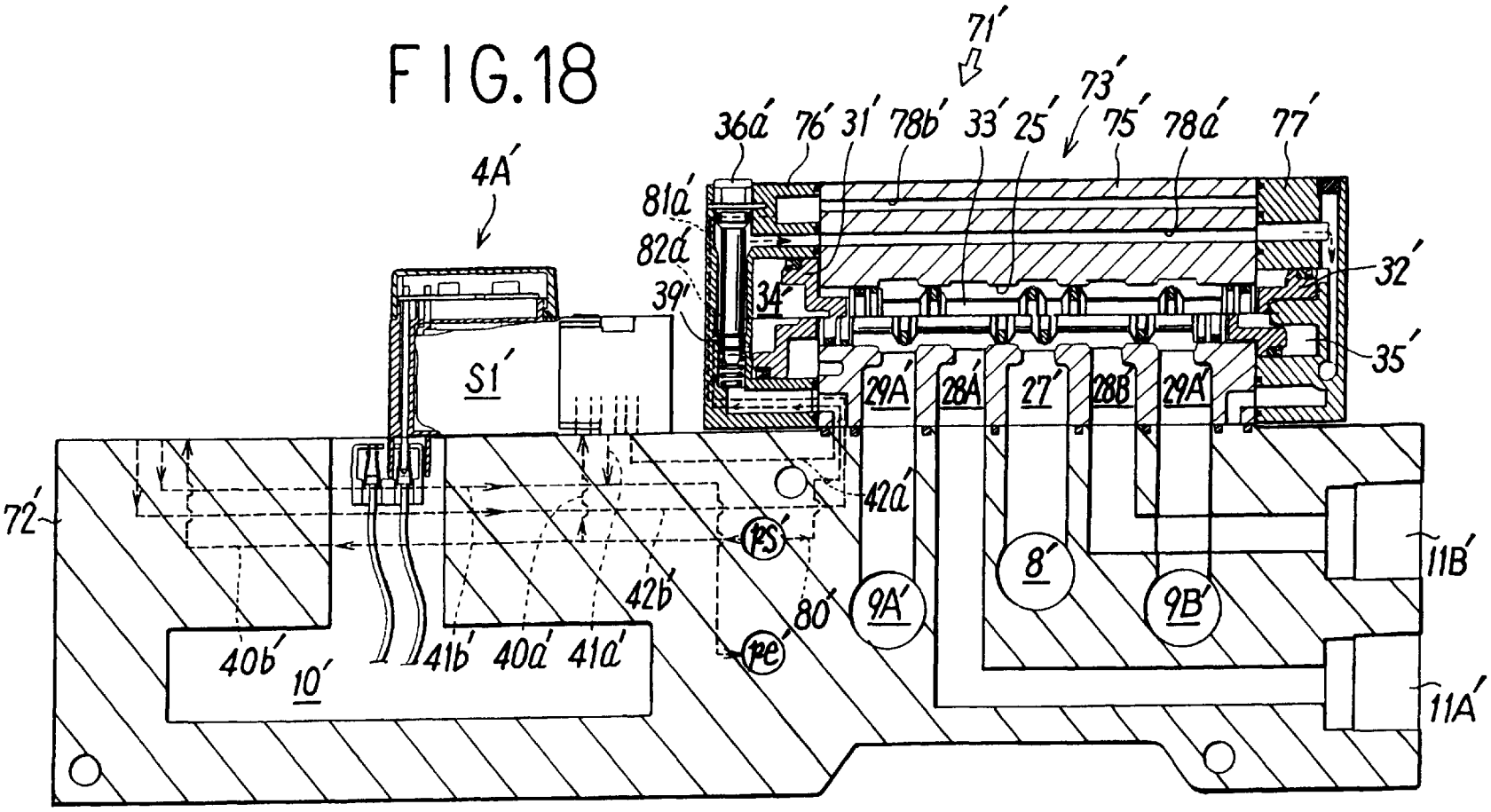
FIG. 18 is a vertical cross sectional side view showing a third embodiment of the second aspect of the invention.

FIG. 18 shows a third embodiment of the second aspect of the invention. A pilot solenoid valve 71' of single solenoid valve type includes a main valve 73' and a pilot valve 4A', which are of an external pilot type, but also have an installation surface for second pilot valve 4B' on manifold base 72'. In manifold base 72', the pilot passages collectively open to first piston box 76' in valve body 75'. The manifold base according to this embodiment differs from those in the first and second embodiments of the second aspect of the invention and requires compatible main valve 73'.

But since the basic configuration of manifold base 72' is the same as in the first and second embodiments of the second aspect of the invention, manifold bases 2', 62', and 72' can be formed of the same material by somewhat modifying the locations and number of pilot passages. In addition, when manifold bases are joined as shown in FIGS. 13 and 14, these types of manifolds can be mixed.

Main valve 73' includes a valve body 75' and first and second piston boxes 76' and 77' at either axial end. Valve hole 25' and first and second pilot passages 78*a*' and 78*b*' are axially formed in valve body 75'. The first piston box 76' includes first piston 31', first pressure chamber 34', and manual operation button 36*a*'. A second piston box 77' includes second piston 32' and second pressure chamber 35', of smaller diameter than first piston 31' and first pressure chamber 34'.

As described above, one end of external pilot passage 80' and first and second pilot output passages 42*a*' and 42*b*' collectively open to the valve installation surface of manifold base 72', near first piston box 76' of valve body 75'. The first pilot output passage 42*a*' communicates with first pressure chamber 34' of first piston box 76', as in main valve 3' according to the first embodiment of the second aspect of the invention. The second pilot output passage 42*b*' communicates with second pilot passage 78*b*' in valve body 75' through passage 81*a*' in first piston box 76', but its end is closed with the second piston box 77'.

External pilot passage 80' communicates with second pressure chamber 35' of second piston box 77' through passage 82*a*', and the gap around manual operation button 36*a*' and first pilot passage 78*a*'.

The other configuration of the third embodiment of the second aspect of the invention shown in FIG. 18 is identical to the first embodiment shown in FIG. 11, with main components having the same reference numbers. A detailed description is omitted.

In the pilot solenoid valve according to the third embodiment of the second aspect of the invention, when pilot valve 4A' is operated to supply a pilot fluid to first pressure chamber 34', valve body 33' moves to the right of the figure to switch the channel (see the upper half of the valve body in FIG. 18). When operation of the first pilot valve 4A' is stopped to eject pilot fluid from first pressure chamber '34, valve body '33 is moved to the left of the figure by the external pilot fluid supplied to pressure chamber 35' of second piston box 77' through passage 82*a*' and pilot passage 78*a*' (see lower half of the valve body in FIG. 16).

If an accident occurs and manual operation button 36*a*' is pressed, the external pilot passage 80' communicates with first pressure chamber 34' through passage 82*a*'. Seal packing 39' blocks communication between first pressure chamber 34' and first pilot output channels 42*a*', causing the external pilot fluid to flow into first pressure chamber 34' and move valve body 33' to the right of the figure. When manual operation button 36*a*' is released, the pilot fluid in the first pressure chamber 34' is ejected outside and supplied to the second pressure chamber 35' through passage 78*a*', causing valve body 33' to move to the left of the figure.

Figure 19:
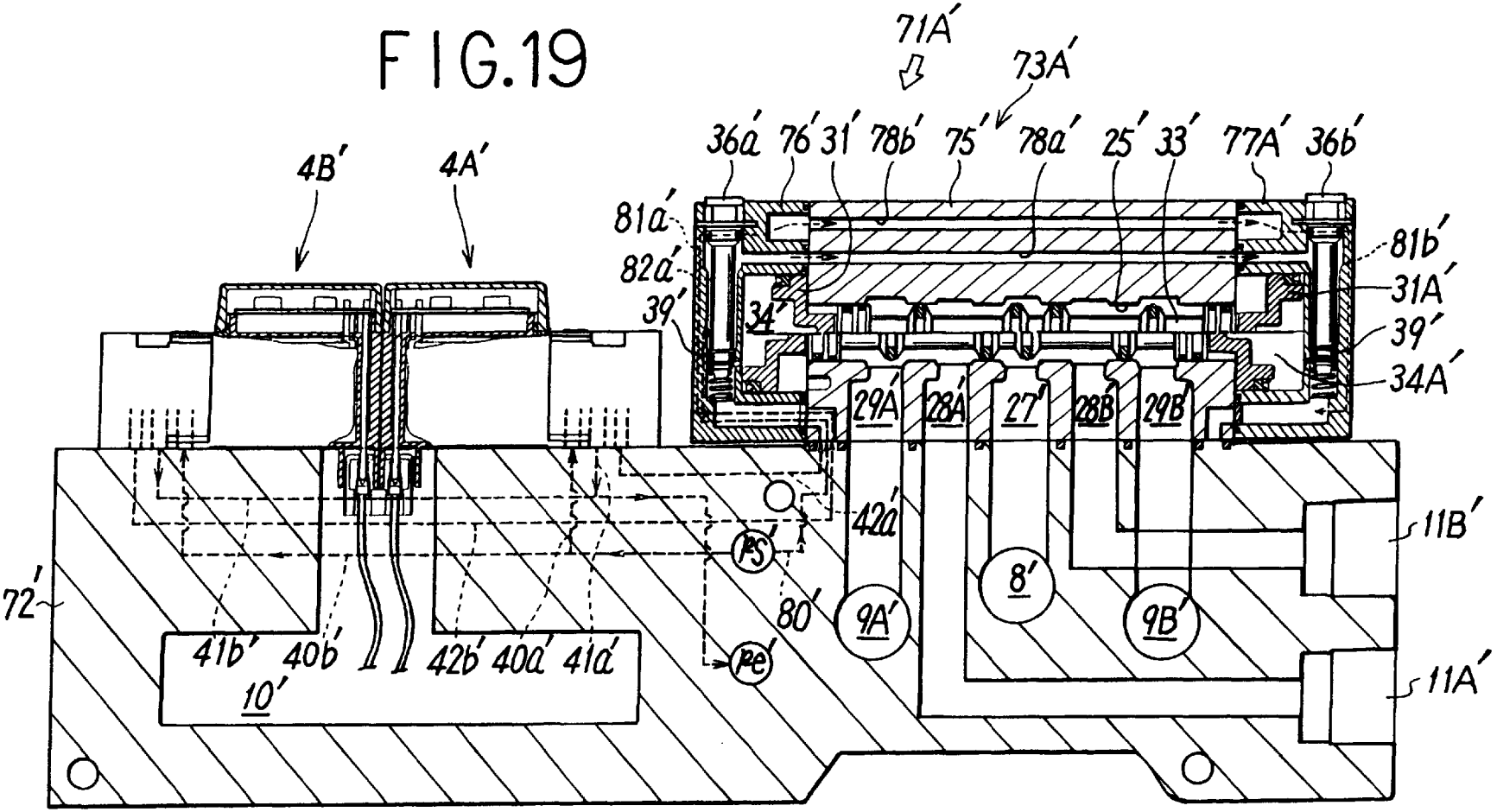
FIG. 19 is a vertical cross sectional side view showing a variation of the third embodiment of the second aspect of the invention.

FIG. 19 shows a variation in which double solenoid main valve 73A' is installed on the same manifold base 72' of the third embodiment of the second aspect of the invention. A second piston box 77A' in main valve 73A' in pilot solenoid valve 71A' includes second piston 31A' and second pressure chamber 34A', which have the same diameters as first piston 31' and first pressure chamber 34' in first piston box 76'. It also has a manual operation button 36*b*', similar to the manual operation button 36*a*' of first piston box 76'.

First pilot output passage 42*a*' communicates with first pressure chamber 34' of first piston box 76'. Second pilot output passage 42*b*' communicates with second pressure chamber 34A' via passage 81*a*' in first piston box 76' and second pilot passage 78*b*' in valve body 75', and through passage 81*b*' in second piston box 77A'. External pilot passage 80' communicates with the gap in the insertion hole of second manual operation button 36*b*' through passage 82*a*', the gap around the manual operation button 36*a*', and first pilot passage 78*a*'. Under the conditions shown in the figure, seal packing 39' of second manual operation button 36*b*' blocks communication with second pressure chamber 34A'.

The other configuration and effects of solenoid valves 71' and 71A' are the same as with solenoid valves 1' and 1A', with main components having the same reference numbers. A detailed description is omitted.

Solenoid valves 71' and 71A' according to the third embodiment of the second aspect of the invention (and a variation of this embodiment) have the same configuration as the first and second embodiments of the second aspect of the invention, except for second piston boxes 77' and 77A'. This facilitates the specification changes between single solenoid and double solenoid types.

Figure 20:
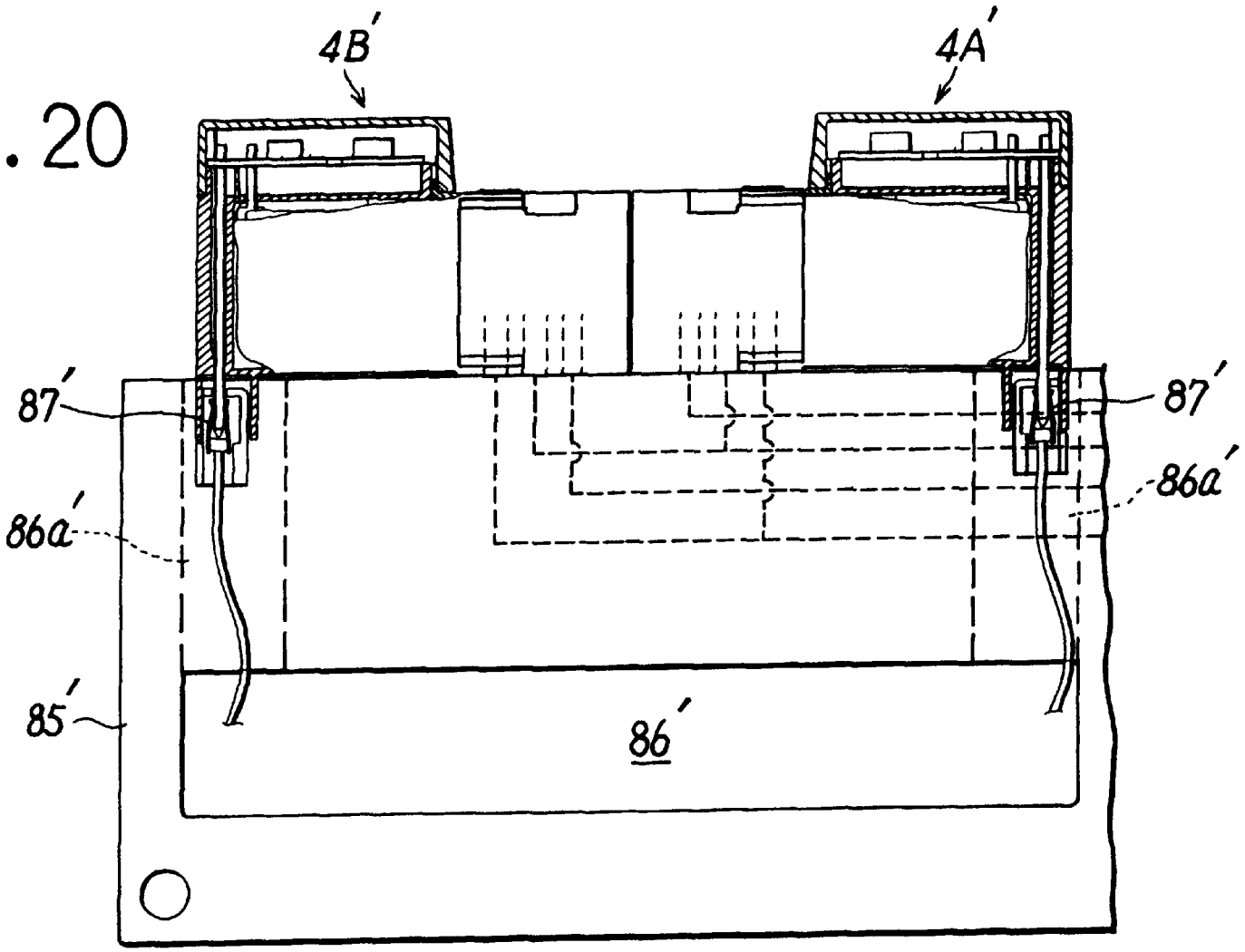
FIG. 20 is a partial side cross sectional view showing a variation of a socket mounting section in a manifold base.

FIG. 20 shows a variation in which socket mounting section 10*a*' of the manifold base, in each embodiment, and socket 51' to which the feeding terminals 48' of the pilot valves 4A' and 4B' are connected, are provided between a pair of pilot valves 4A' and 4B'. In this variation, a pair of socket mounting sections 86*a*' are formed at either end of the installation surface of manifold base 85' for pilot valves 4A' and 4B', and a socket 87' is provided in each of the socket mounting sections 86*a*'. This configuration can be used for each of the above embodiments of the second aspect of the invention.

In each of the above embodiments of the second aspect of the invention, feeding line 52' feeding solenoids s1' and s2' can be connected directly to feeding terminal 48', without passing through feeding line housing passage 10'. In order to execute feeding from above pilot valves 4A' and 4B'.

Figure 21:
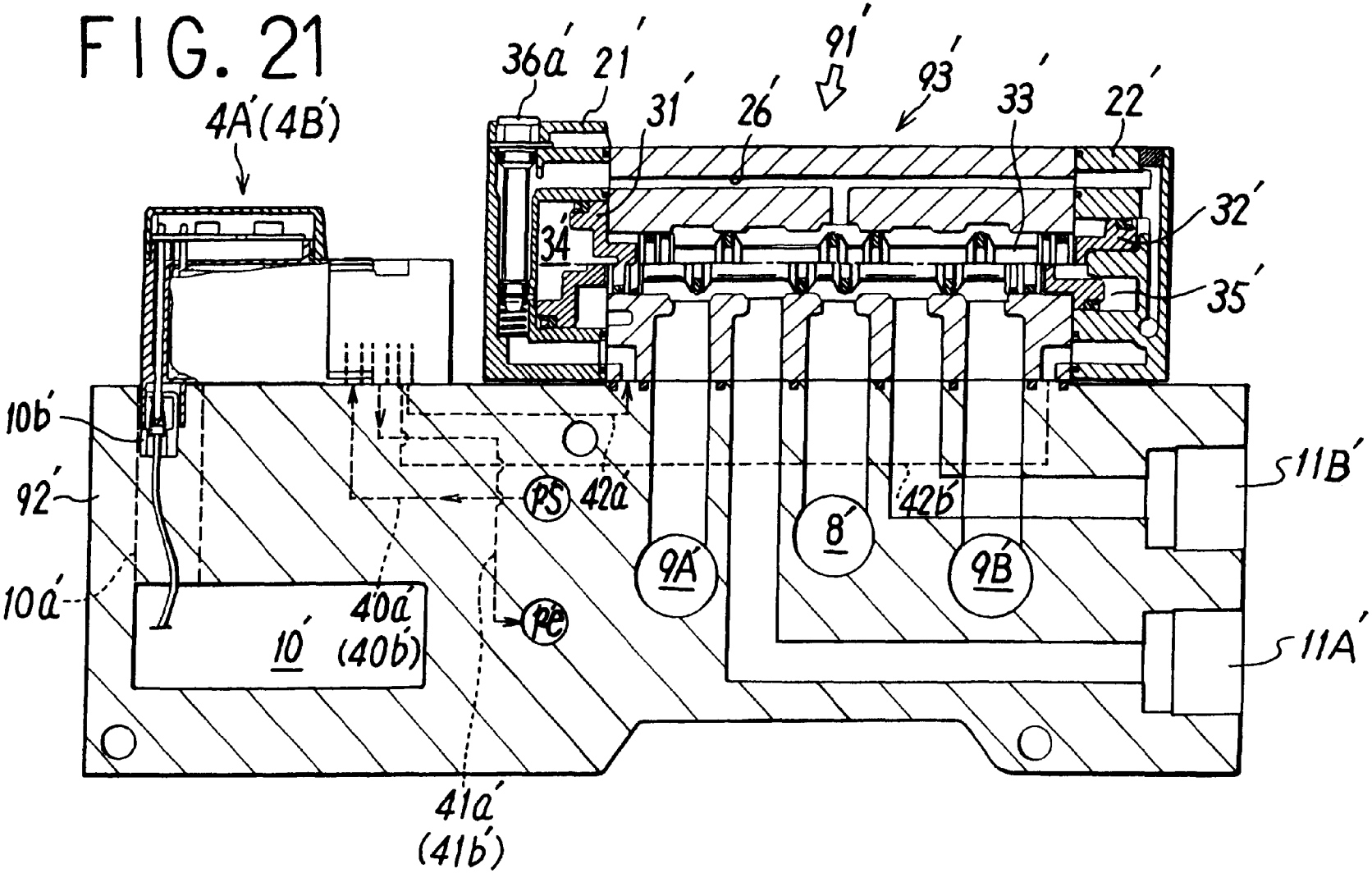
FIG. 21 is a vertical cross sectional side view showing a fourth embodiment of the second aspect of the invention.
Figure 22:
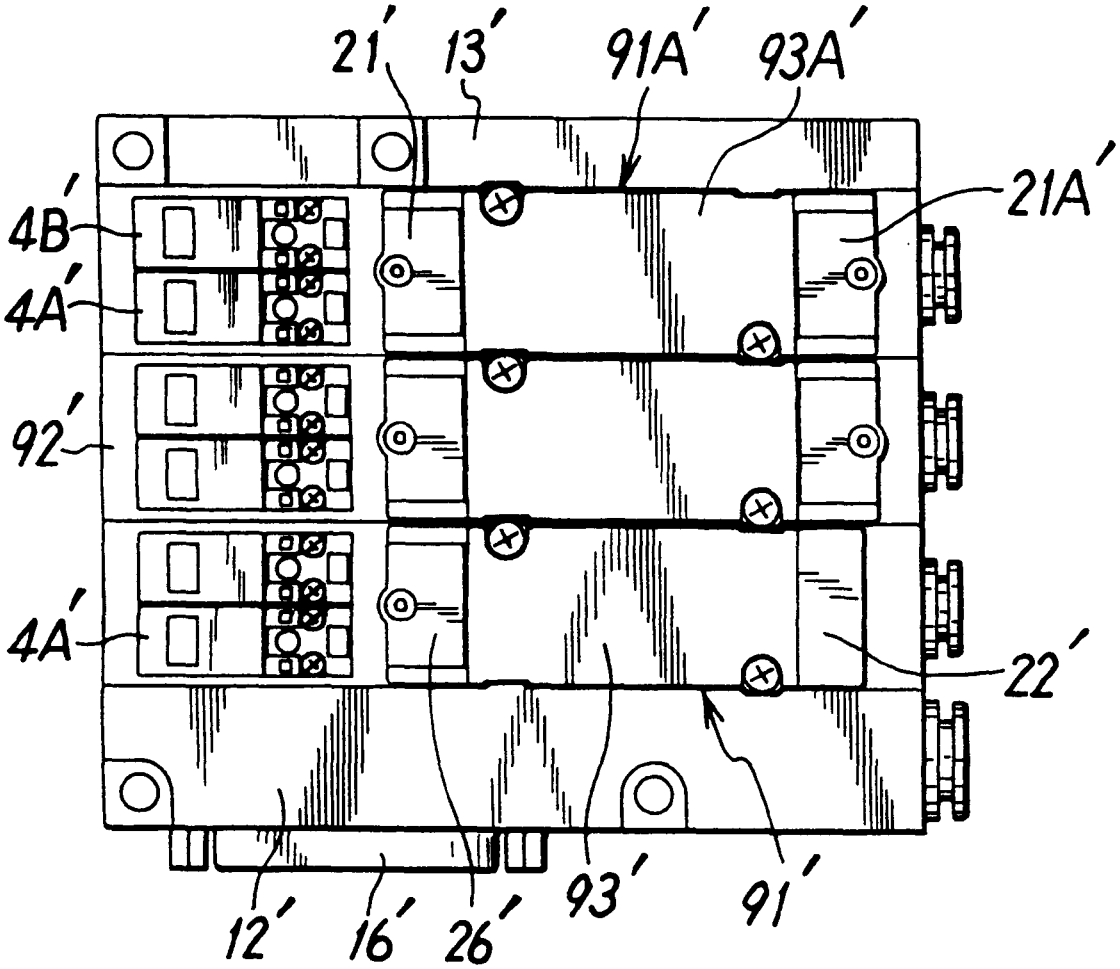
FIG. 22 is a plan view showing an implementation in which pilot solenoid valves are joined according to the fourth embodiment of the second aspect of the invention.

Each embodiment of the second aspect of the invention above has the main valve and the two pilot valves positioned in series. FIGS. 21 and 22 show a fourth embodiment of the second aspect of the invention, in which the two pilot valves are positioned in parallel.

A pilot solenoid valve 91' in FIG. 21 includes a single solenoid type main valve 93' (see FIG. 21) and the pilot valve 4A', while a pilot solenoid valve 91A' in FIG. 22 includes a double solenoid main valve 93A' and pilot valves 4A' and 4B', which are installed in parallel along the axis in which manifold bases 92' are joined, as shown in FIG. 21.

Main valves 93' and 93A' in solenoid valves 91' and 91A' have the same configuration as main valves 3' and 3A' in the first embodiment of the second aspect of the invention, but may be of the single or double solenoid type described in other embodiments of the second aspect of the invention. A requisite number of solenoid valves 91' and/or 91A' can be joined, as shown in FIG. 22.

Manifold base 92' must be configured according to the solenoid valve to be installed, but due to installation in parallel of pilot valves 4A' and 4B', its longitudinal length and the positions in the top surface where pilot passages and wiring housing passage 10' open differ from those in other manifold bases. Still, passages and wiring housing passage in manifold bases are joined tightly in the direction in which the manifolds are joined.

Because the pilot valves 4A' and 4B' are installed as described, the pilot solenoid valve in the fourth embodiment of the second aspect of the invention is compact. The longitudinal length is reduced, despite an increase in width in the direction in which the manifold bases 92' are joined.

This embodiment is particularly effective when the number of pilot solenoid valves joined is small or when the main valve has a larger diameter than pilot valves 4A' and 4B', due to its flow.

The other configuration and effects of the fourth embodiment are the same as the first to third embodiments of the second aspect of the invention. A description is omitted.

In the pilot solenoid valve, according to each of the embodiments of the second aspect of the invention described above, since the main and pilot valves are installed discretely on the manifold base, the single or double solenoid type main valve can first be installed on the valve installation surface of the manifold base and one or two pilot valves then installed, depending on the main valve, thereby enabling a single or double solenoid type pilot solenoid valve.

In order to change specification of the pilot solenoid valve or to repair or replace defective parts, only the part or parts in question need be replaced. There is no need to replace both main and pilot valves, in contrast to solenoid valves with pilot valves directly attached to a main valve. Since the main and pilot valves are installed separately, maintenance and inspection can be done without contacting pilot valves that have electric wiring. This feature improves safety and makes repair cheaper.

As described above in detail, in this pilot solenoid valve, the main valve and two pilot valves are installed discretely on their installation surface. This enables the part or parts in question to be replaced without replacing both the main and pilot valves in the event of specification changes, failure, maintenance, or inspection. This facilitates specification changes, repair, and replacement, and also reduces costs.

What is claimed as new and desired to be secured by Letters Patent of the United States is:

1. A pilot solenoid valve on a manifold base, consisting of a main valve for switching an output opening between a supply opening and an ejection opening for communication; and pilot valves driven by a solenoid to drive a valve body of the main valve, the pilot solenoid valve axially driving the valve body of the main valve using pilot fluid supplied or ejected through the pilot valves in order to switch a channel between openings for communication; in which:

main and pilot valves are independently installed on the manifold base, separate from each other and arranged in parallel in the axial direction of the valve body of the main valve; and in which the manifold base includes a feeding line housing passage through which feeding lines for feeding the pilot valves pass, wherein said feeding lines are positioned under at least one of a main valve installation position and an installation surface between the main valve installation position and a pilot valve installation position; and a waterproof cover protecting at least one of the pilot valves and an energization system of the at least one pilot valve, extending from the feeding line to the pilot valve;

wherein the installation surfaces for the pilot valves are substantially planar.

2. A pilot solenoid valve according to claim 1, in which an installation surface for two solenoid-driven pilot valves that drive the valve body of the main valve in its axial direction either forward or back is provided on the manifold base, in the axial direction of the valve body of said main valve.

3. A pilot solenoid valve according to claim 2, wherein said pilot valve further comprises a manual operation button that when pressed switches communication between channels connected to the pilot valve; and in which is provided a manual press section capable of pressing and operating the pilot manual operation button when externally pressed, located at the position in the waterproof cover corresponding to the pilot manual operation button.

4. A pilot solenoid valve according to claim 1, in which an installation surface for two solenoid-driven pilot valves that drive the valve body of the main body in its axial direction either forward or back is provided on the manifold base, in a direction orthogonal to the axial direction of the valve body of said main valve.

5. A pilot solenoid valve according to claim 4, wherein said pilot valve further comprises a manual operation button that when pressed switches communication between channels connected to the pilot valve; and in which is provided a manual press section capable of pressing and operating the pilot manual operation button when externally pressed, located at the position in the waterproof cover corresponding to the pilot manual operation button.

6. A pilot solenoid valve according to claim 1, wherein said pilot valve further comprises a manual operation button that when pressed switches communication between channels connected to the pilot valve; and in which is provided a manual press section capable of pressing and operating the pilot manual operation button when externally pressed, located at the position in the waterproof cover corresponding to the pilot manual operation button.

7. A pilot solenoid valve according to claim 1, further comprising a manual operation button installed in one of a main valve and a pilot valve.

8. A pilot solenoid valve assembly comprising:

a main valve having a valve body;

a first and second solenoid valve, each including an electrical feeding terminal; and a manifold base, said manifold base comprising:

a solenoid valve installation surface on which the solenoid valves are installed;

a main valve installation surface on which said main valve is installed;

pressure fluid supply channels extending through said manifold base in a direction in which a plurality of manifold bases are to be joined;

an output port opening to a front end surface of said manifold base;

passages that allow channels and ports to open into corresponding openings in the installation surfaces;

first and second pilot supply and ejection channels that open into positions corresponding to pilot supply and ejection openings of the solenoid valves in said solenoid valve installation surface;

first and second pilot output passages, a first end of each of said first and second pilot output passages opening into a corresponding pilot output opening in a corresponding solenoid installation surface, a second end of each of said first and second pilot output passages opening into a corresponding pilot fluid passage in a corresponding main valve installation surface; and at least one electrical feeding socket mounted to said manifold base and configured to receive said electrical feeding terminal of said solenoid valve, wherein said electrical feeding socket is connected to a feeding line in a feeding line housing passage provided in said manifold base;

wherein said main valve and said solenoid valves which operate said main valve are installed on the corresponding installation surfaces such that they are installed separately and stand discretely.

* * * * *